US010323417B2

(12) United States Patent
Kulkarni et al.

(10) Patent No.: US 10,323,417 B2
(45) Date of Patent: Jun. 18, 2019

(54) METHODS, SYSTEMS AND APPARATUS FOR ROOF DE-ICING

(71) Applicant: Calorique, LLC, West Wareham, MA (US)

(72) Inventors: Kapildev M. Kulkarni, Sharon, MA (US); Eugene B McGillycuddy, Suffern, NY (US)

(73) Assignee: CALORIQUE, LLC, West Wareham, MA (US)

( * ) Notice: Subject to any disclaimer, the term of this patent is extended or adjusted under 35 U.S.C. 154(b) by 680 days.

(21) Appl. No.: 14/837,818

(22) Filed: Aug. 27, 2015

(65) Prior Publication Data

US 2016/0060871 A1 Mar. 3, 2016

Related U.S. Application Data

(60) Provisional application No. 62/043,282, filed on Aug. 28, 2014.

(51) Int. Cl.

| | |
|---|---|
| ***E04D 13/10*** | (2006.01) |
| ***H05B 1/02*** | (2006.01) |
| ***H05B 3/34*** | (2006.01) |

(52) U.S. Cl.

CPC ..... *E04D 13/103* (2013.01); *H05B 1/0252* (2013.01); *H05B 3/34* (2013.01); *H05B 2203/011* (2013.01); *H05B 2203/013* (2013.01); *H05B 2214/02* (2013.01)

(58) Field of Classification Search

None

See application file for complete search history.

(56) References Cited

U.S. PATENT DOCUMENTS

| | | | | |
|---|---|---|---|---|
| 3,129,316 | A * | 4/1964 | Glass | E04D 13/103 219/213 |
| 3,691,343 | A * | 9/1972 | Norman | E04D 13/103 165/47 |
| 3,725,638 | A * | 4/1973 | Solin | E04D 13/103 219/213 |
| 4,141,187 | A * | 2/1979 | Graves | E04D 7/00 219/213 |
| 4,485,297 | A | 11/1984 | Grise et al. | |
| 4,733,059 | A | 3/1988 | Goss et al. | |
| 5,813,184 | A * | 9/1998 | McKenna | H05B 3/00 52/518 |
| 7,121,056 | B2 * | 10/2006 | McKenna | E04D 1/26 52/518 |
| 8,575,523 | B2 * | 11/2013 | Chivers | H05B 3/34 219/213 |
| 9,095,007 | B2 * | 7/2015 | McGillycuddy | E04D 13/103 |

(Continued)

*Primary Examiner* — Joseph M Pelham

(74) *Attorney, Agent, or Firm* — Wilmer Cutler Pickering Hale and Dorr LLP

(57) ABSTRACT

In an aspect a heating system includes a grounded shield layer made of a continuous piece of metal; a heating element; and a rear adhesive layer comprising of a flame retardant material. The heating element is disposed between the grounded shield layer and the rear adhesive layer; and the rear adhesive layer has a bottom surface that is configured to adhere to at least one of a shingle or an area of a roofing deck. Additionally, a controller is included and is configured to control the flow of electricity to the heating element as a function of a temperature and at least one of a moisture level and a precipitation level.

30 Claims, 21 Drawing Sheets

(56) References Cited

U.S. PATENT DOCUMENTS 9,426,845 B2 * 8/2016 Hopkins, II ..... H05B 3/34
9,428,915 B2 * 8/2016 Nark ..... E04D 13/103
9,603,196 B2 * 3/2017 Irgens ..... H05B 3/34
2004/0244324 A1 * 12/2004 McKenna ..... E04D 1/26 52/533
2005/0193637 A1 * 9/2005 Petroff ..... E04D 13/103 52/11
2006/0288652 A1 * 12/2006 Gurr ..... E04D 13/103 52/198
2006/0289110 A1 * 12/2006 Schmitt ..... H05B 3/36 156/250
2009/0200285 A1 * 8/2009 Raidt ..... F24D 13/022 219/213
2010/0021683 A1 * 1/2010 Junghans ..... H05B 3/34 428/116
2010/0024324 A1 * 2/2010 Meinzer ..... E04D 13/103 52/173.1
2010/0170889 A1 * 7/2010 Keite-Telgenbuscher ..... C09J 7/38 219/546
2010/0175824 A1 * 7/2010 Hopkins ..... H05B 3/34 156/249
2010/0213189 A1 * 8/2010 Keite-Telgenbuescher ..... B60R 1/0602 219/548
2011/0042366 A1 * 2/2011 Martin ..... E04D 13/0445 219/213
2011/0089154 A1 * 4/2011 Aussi ..... E04D 13/064 219/213
2011/0229680 A1 * 9/2011 Glenn ..... B32B 3/22 428/68
2011/0232210 A1 * 9/2011 Backe ..... E04D 13/103 52/173.3
2012/0132759 A1 * 5/2012 Sager ..... E04D 13/076 248/49
2013/0055661 A1 * 3/2013 McGillycuddy ..... E04D 13/103 52/173.1
2013/0213950 A1 * 8/2013 Bulgajewski ..... H05B 1/00 219/209
2013/0319990 A1 * 12/2013 Casey ..... E04D 13/103 219/213
2014/0076877 A1 * 3/2014 Cheng ..... H05B 3/34 219/212
2014/0097178 A1 * 4/2014 Whitcraft ..... H05B 3/34 219/528
2014/0263266 A1 * 9/2014 Jenkins ..... E04D 13/103 219/213
2014/0263267 A1 * 9/2014 Jenkins ..... E04D 13/103 219/213
2014/0299593 A1 * 10/2014 Casey ..... H05B 3/565 219/476
2015/0014298 A1 * 1/2015 Hopkins, II ..... H05B 3/34 219/481

* cited by examiner

METHODS, SYSTEMS AND APPARATUS FOR ROOF DE-ICING

CROSS REFERENCE TO RELATED APPLICATIONS

This application claims the benefit or priority under 35 C.F.R. § 119(e) to U.S. Patent Application No. 62/043,282, filed on Aug. 28, 2014, the contents of which are incorporated by reference herein in its entirety.

BACKGROUND

Typically, in the construction of homes it is important to protect roofs from leaks due to ice and rain. Traditionally, felt paper was secured to wooden roofs underneath shingles. The felt paper would absorb ice or water that penetrated the shingles, preventing it from reaching the underlying wood. Nailing the felt paper to the roof, however, caused spaces around the nail through which water could seep. The water could follow the nail into the wood, causing leaks in the home. To solve this problem, water shields began to include an adhesive backing to fasten the shield to the wood, instead of using nails. The adhesive backing includes a peel-able strip which, when removed, exposes the adhesive layer for affixing the water shield to the unprotected wooden roof. The top of these water shields were made of a rubberized asphalt material, which created a gasket effect on the shaft of the nail driven through it. These water shields were successful in preventing many types of leaks.

In colder climates, however, ice dams can form and allow water to penetrate or flow under the water shield. For example, an ice dam can prevent melt-water from flowing downward off the roof, which can result in the water seeping into the house above the ice and water shield coverage area. Ice dams occur when snow accumulates on the roof of a house with inadequate insulation. Heat conducted through the insufficiently insulated roof, and warm air from the space below, warms the roof and melts the snow on areas of the roof that are above living spaces. It does not, however, melt the snow over cold areas, such as roof overhangs. In these situations, melt-water from the heated areas of the roof flows down the roof, under the blanket of snow, onto the overhang and into the gutter, where colder conditions permit it to freeze. Eventually, ice accumulates along the overhang and in the gutter. Snow that melts later cannot drain properly, backs up on the roof and can result in damaged ceilings, walls, roof structure, and insulation. To avoid this many building codes require a water shield covering the roof two feet into the living space.

Additionally, in the past, heating wires and cable-based deicing systems have been disposed on top of the shingles on roofs. These remedial routes provide heat to melt channels in the deposited ice to restore drainage of water through accumulated ice and snow thereby preventing the problems resulting from ice dams. However, since the solution is topical and restricted to the formation of channels at selective areas under severe weather conditions, the efficacy of these solutions is not adequate to prevent leaks from ice dam formation. Furthermore, heating wires and cable-based deicing systems are visible and aesthetically unsightly, easily damaged, and needed to be replaced frequently.

A need for a robust solution that address the ice dam problem persists.

SUMMARY

In an aspect a heating system includes a grounded shield layer made of a continuous piece of metal; a heating element; and a rear adhesive layer comprising of a flame retardant material. The heating element is disposed between the grounded shield layer and the rear adhesive layer; and the rear adhesive layer has a bottom surface that is configured to adhere to at least one of a shingle or an area of a roofing deck. Additionally, a controller is included and is configured to control the flow of electricity to the heating element as a function of a temperature and at least one of a moisture level and a precipitation level.

In some embodiments, the grounded shield layer has a transverse dimension forming two transverse edges which is shorter than the width of the rear adhesive layer; and the rear adhesive layer is configured to fold over at least one of the transverse edges of the grounded shield layer to form a region of folded-over rear adhesive strip. In some other embodiments, the region of the folded rear adhesive strip is adhered to a shingle disposed on top of the heating system.

In some embodiments, the grounded shield layer is flexible.

In some embodiments, the grounded shield layer is made of a metal-containing electrically conducting foil. In some other embodiments, the metal-containing electrically conducting foil is painted over with a weather resistant and UV resistant paint.

In some embodiments, the controller is configured to control the flow of electricity continuously, at specific intervals and/or with manual regulation of an operator.

In some embodiments—the controller is configured to flow electricity when the ambient temperature is below a predetermined threshold.

In some embodiments, the rear adhesive layer is covered by a release liner that is configured to be removed before installation.

In some embodiments, the flame retardant material comprising the rear adhesive layer is selected from a group consisting of flame retardant acrylic adhesives, flame retardant epoxy adhesives, flame retardant silicone adhesives, flame retardant polyether adhesives, flame retardant foams, flame retardant rubber compounds, flame retardant polyurethane, flame retardant non-woven fabric and combinations thereof.

In some embodiments, the heating element includes a pair of longitudinal stripes spaced apart from each other; and a plurality of transverse bars configured to be spaced apart from each other to cause substantially uniform heating and extending between the longitudinal stripes. In some other embodiments, the pair of longitudinal stripes are made of a material comprising copper.

In some embodiments, the heating system further includes an additional adhesive layer including of a flame retardant material; wherein, the additional adhesive layer is disposed on top of the grounded shield layer and configured to adhere to the shingle disposed on top of the heating system. In some other embodiments, the flame retardant material comprising the additional adhesive layer is selected from a group consisting of flame retardant acrylic adhesives, flame retardant epoxy adhesives, flame retardant silicone adhesives, flame retardant polyether adhesives, flame retardant foams, flame retardant rubber compounds, flame retardant polyurethane, flame retardant non-woven fabric and combinations thereof.

In an aspect a heated roof system includes a first course of shingles or an area of a roofing deck; a second course of shingles wherein, the second course of shingles is disposed over at least one of a part of the first course of shingles and a part of the area of the roofing deck to create an area of overlap. The heated roof system further includes a heating system disposed in the area of overlap, wherein, the heating system includes a grounded shield layer made of a continuous piece of metal; a heating element; and a rear adhesive layer including a flame retardant material. The heating element is disposed between the grounded shield layer and the rear adhesive layer; wherein the rear adhesive layer has a bottom surface that is configured to adhere to at least one of a shingle or an area of a roofing deck. Additionally, a controller is included that is configured to control the flow of electricity to the heating element as a function of a temperature and at least one of a moisture level and a precipitation level.

In some embodiments, the first course of shingles is installed over an overhang of a roof.

In some embodiments, the grounded shield layer has a transverse dimension forming two transverse edges which is shorter than the width of the rear adhesive layer; and wherein, the rear adhesive layer is configured to fold over at least one of the transverse edges of the grounded shield layer to form a region of folded-over rear adhesive strip. In some other embodiments, the region of folded rear adhesive strip is adhered to the second course of shingles disposed on top of the heating system. In some other embodiments, the second course of shingles disposed on top of the heating system remain adhered to the region of folded-over adhesive strip upon exposure to a high speed wind. In some other embodiments, the high speed wind is a hurricane force wind of speeds greater than 130 mph.

In some embodiments, the grounded shield layer is flexible.

In some embodiments, the grounded shield layer is made of a metal-containing electrically conducting foil. In some other embodiments, the metal-containing electrically conducting foil is painted over with a weather resistant and UV resistant paint.

In some embodiments, the controller is configured to control the flow of electricity continuously, at specific intervals and/or with manual regulation of an operator.

In some other embodiments, the controller is configured to flow electricity when the ambient temperature is below a predetermined threshold.

In some other embodiments, the rear adhesive layer is covered by a release liner that is configured to be removed before installation.

In some other embodiments, the flame retardant material comprising the rear adhesive layer is selected from a group consisting of flame retardant acrylic adhesives, flame retardant epoxy adhesives, flame retardant silicone adhesives, flame retardant polyether adhesives, flame retardant foams, flame retardant rubber compounds, flame retardant polyurethane, flame retardant non-woven fabric and combinations thereof.

In some other embodiments, the heating element includes a pair of longitudinal stripes spaced apart from each other; and a plurality of transverse bars configured to be spaced apart from each other to cause substantially uniform heating and extending between the longitudinal stripes. In some other embodiments, the pair of longitudinal stripes of the heating element are made of a material comprising copper.

In some embodiments, the heated roof system further includes an additional adhesive layer including of a flame retardant material; wherein, the additional adhesive layer is disposed on top of the grounded shield layer and configured to adhere to the shingle disposed on top of the heating system. In some other embodiments, the flame retardant material comprising the additional adhesive layer is selected from a group consisting of flame retardant acrylic adhesives, flame retardant epoxy adhesives, flame retardant silicone adhesives, flame retardant polyether adhesives, flame retardant foams, flame retardant rubber compounds, flame retardant polyurethane, flame retardant non-woven fabric and combinations thereof.

BRIEF DESCRIPTION OF THE FIGURES

The above and other objects and advantages of the present disclosure will be apparent upon consideration of the following detailed description, taken in conjunction with the accompanying drawings, in which like reference characters refer to like parts throughout.

DETAILED DESCRIPTION

Embodiments, of the invention can provide techniques for preventing and eliminating ice dams and snow buildup of the roofs. In an aspect, a heating system includes a grounded shield layer made of a continuous piece of metal, a heating element; and a rear adhesive layer. The heating element is disposed between the grounded shield and the rear adhesive layer and the rear adhesive layer is made of a flame retardant material. The rear adhesive layer also has a bottom surface that is configured to adhere to at least one of a shingle or an area of a roofing deck. Additionally, a controller is included and is configured to control the flow of electricity to the flexible heater as a function of a temperature and at least one of a moisture level and a precipitation level.

Figure 1:
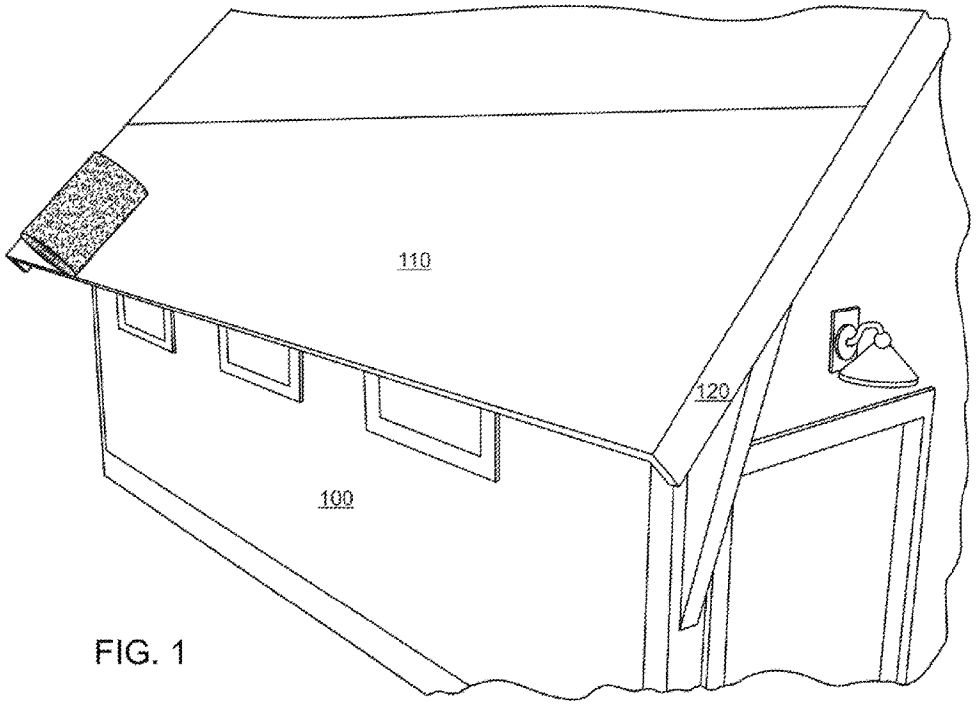
FIG. 1 shows a house with an unprotected wooden roof that includes an overhang which extends beyond a heated living area of the house.

Referring to FIG. 1, a house 100 is shown with an unprotected wooden roof 110. The wooden roof 110 includes an overhang 120 that extends beyond a heated living area of the house 100. Overhang 120 is typically an area where ice dams can form. Typically, the roof 110 is covered with shingles, such as standard asphalt shingles, although other types of shingles can be used, such as, wood, clay, metal, etc.

Figure 2:
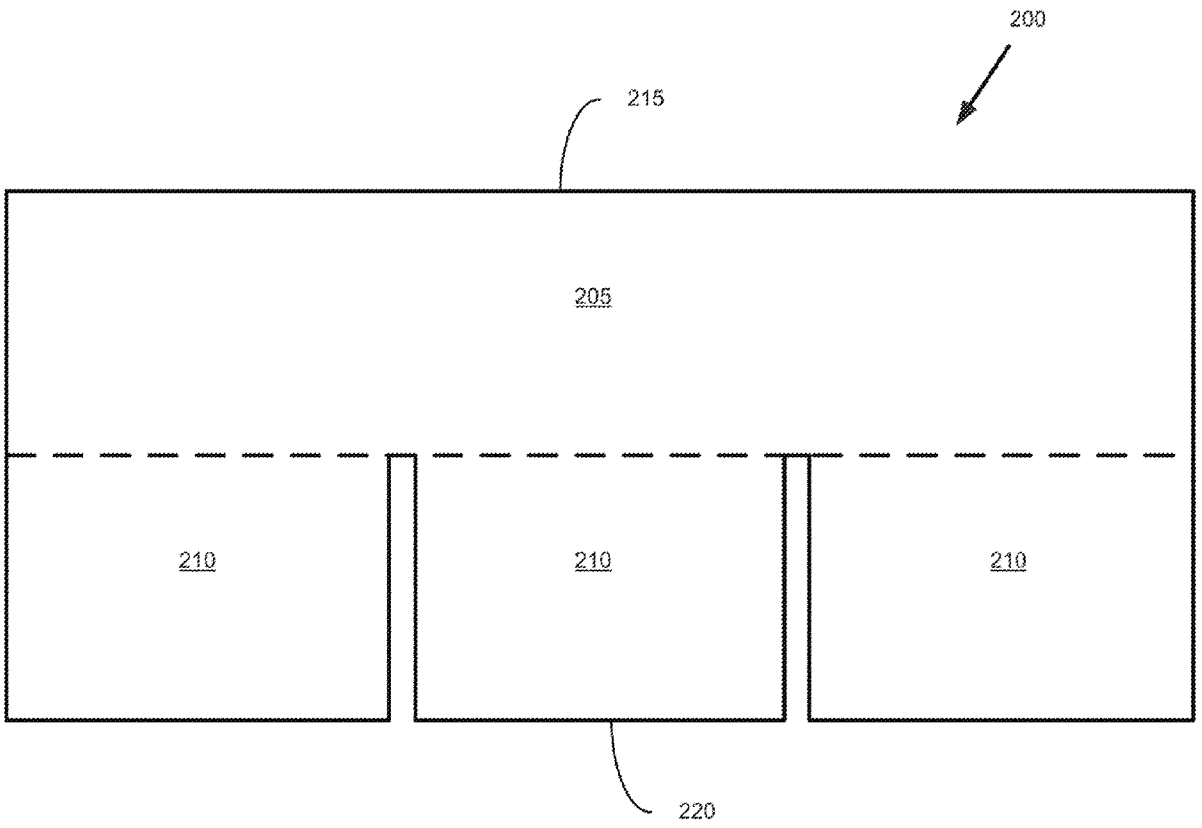
FIG. 2 shows a standard 3-tab shingle.
Figure 3:
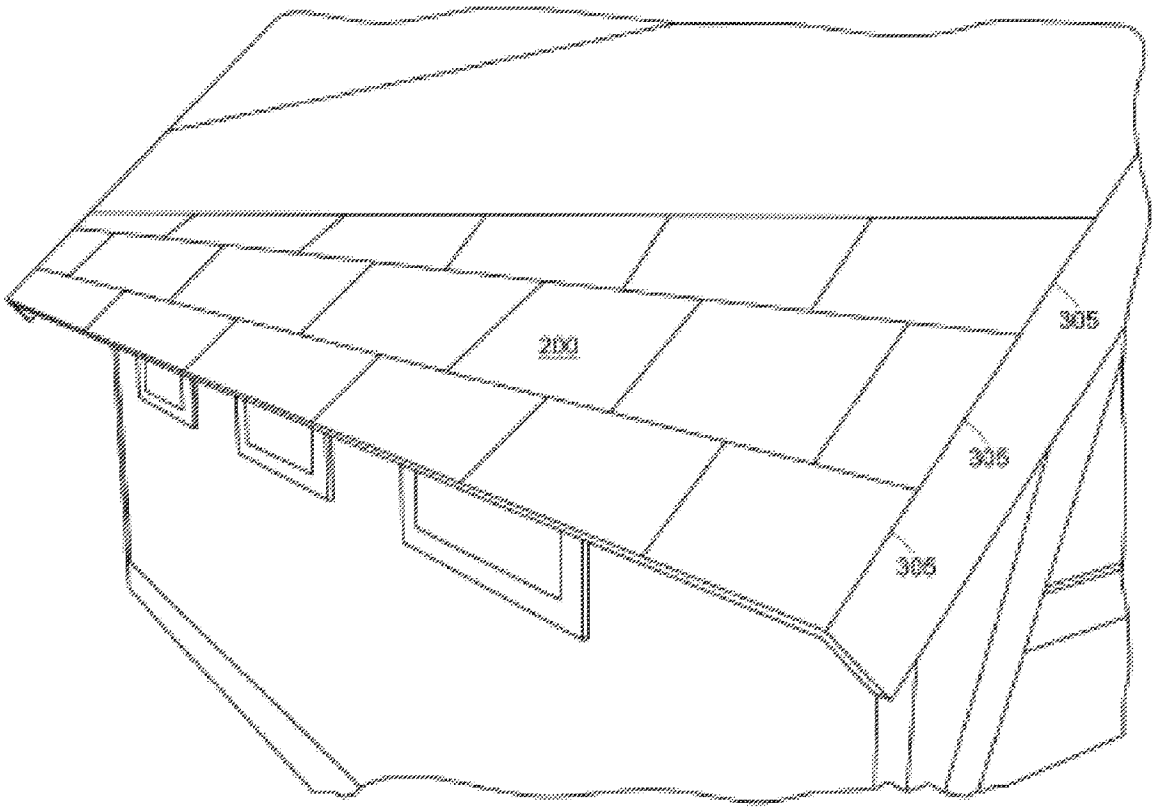
FIG. 3 shows a typical installation include a couple of courses of shingles installed on a roof.

Referring to FIGS. 2-3, a standard 3-tab shingle 200 is shown. The shingle 200 includes a nailing portion 205, and three tabs 210. In a typical installation, shingles 200 are applied to the roof 110 in a series of rows called courses (e.g., 305 in FIG. 3). Typically, a starter course of shingles is nailed to the roof 110 in such a manner that a top 215 of the shingle is even with the bottom of the roof 110 (e.g., the first starter course of shingles is installed upside down). In some embodiments, the tabs 210 may be cut off the starter course. A first course is then applied on top of the starter course such that a bottom 220 of the shingle is even with the bottom of the roof 110 (e.g., the first course can be applied directly on top of the starter course). In order to cover the rest of the roof 110, subsequent courses of the singles 200 are applied in a partially-overlapping manner such that the tabs 210 of one course of shingles are placed over the nailing portion 205 of the course below it.

There are several possibilities for where to install the heating system on a roof structure: under the shingle, on the roof deck, or under the roof deck. In some embodiments, the location between the shingles and the underlying roof structure where there are no nails can be a preferred location for installing the presently disclosed heating system. The presently disclosed heating system can be affixed both to the underlying roof structure and to the shingles disposed on top of the heating system by using, for example, an adhesive. This is an advantage over prior known deicing systems since this heating system does not require nails for installation and may be attached to the shingles with only adhesives.

Figures 4A, 4B:
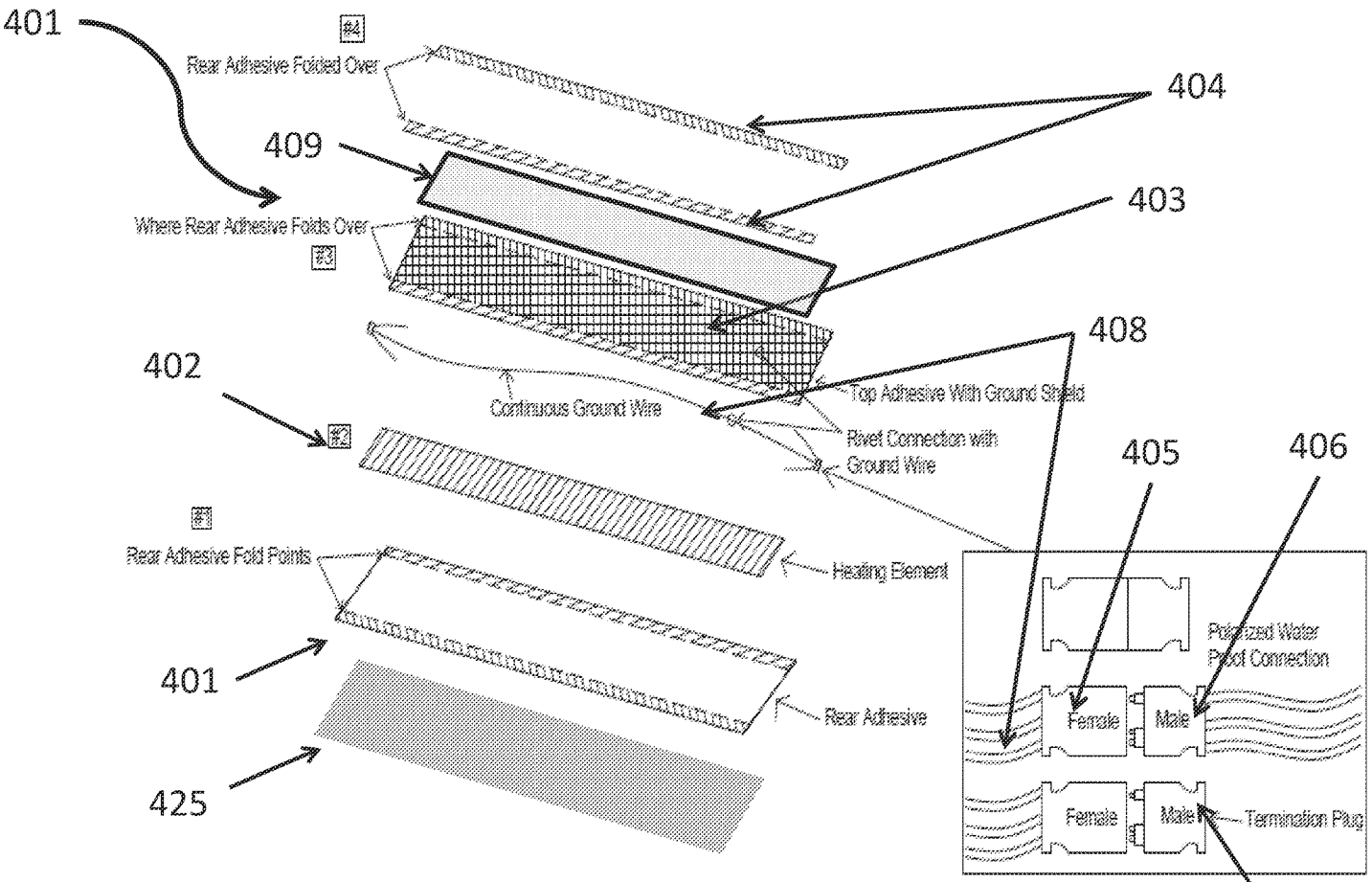
FIG. 4A shows an exploded view of an exemplary heating system 400, in accordance with an embodiment of the invention.
FIG. 4B shows in more detail the electrical connections between heating system disposed adjacent to each other, in accordance with an embodiment of the invention.

FIGS. 4A and 4B shows an exploded view of an exemplary heating system 400, in accordance with an embodiment of the invention. FIG. 4A shows that the heating system 400 includes a rear adhesive layer 401, a heating element 402, a grounded shield layer 403, and folded-over rear adhesive strips 404. Optionally, the heating system may also include a release liner 105 that needs to be removed prior to installation.

In some embodiments, the rear adhesive layer 401 can have flame retardant properties. In certain embodiments, the flame retardant material used for making the rear adhesive layer is selected from a group consisting of flame retardant acrylic adhesives, flame retardant epoxy adhesives, flame retardant silicone adhesives, flame retardant polyether adhesives, flame retardant foams, flame retardant rubber compounds, flame retardant polyurethane, flame retardant non-woven fabric and combinations thereof. In certain other embodiments, the rear adhesive layer 401 can include a Nitto 2125FR flame retardant butyl compound.

In certain embodiments, the rear adhesive layer 401 can be 1.25 mm thick and 7-9" wide. This rear adhesive layer 401 can be dimensioned larger than the heating element 402 and the grounded shield layer 403 such that its edges can fold over the edges of both heating element 402 and grounded shield layer 403 to form folded-over adhesive strips 404. In this way, the rear adhesive layer 401 can serve to bond the heating system to both the underlying roof structure, such as the underlying shingles, metal leaves or roof deck, as well as to roofing shingles or metal leaves disposed on top of the heating system. This methodology and fold-over structure provides for securing the layers of the heating system to the roof and renders the deicing system wind resistant, such that wind gusts would not impact the structural integrity of the deicing system (e.g., such that wind gusts would not be able to dislodge the heating system from the roof, or dislodge roofing shingles bonded to the heating system). In some embodiments the heating system can endure high hurricane force high speed winds with speeds greater than 130 mph.

In some embodiments, heating element 402 can be a heating element produced by Calorique (e.g., model no. IND4-10W120V), and can be a 4-7 inch wide 40 to 120 watts per square foot heating element. Conductive carbon compounds can be rotary screen printed on 0.004 inch (4 mil) polyester film using flat bed or rotary screen or gravure printing process with conductive silver polymer printed buss bars which is laminated with a 0.005 inch (5 mil) dry film polyester film with silver adhesive.

FIG. 4B shows in more detail the electrical connections between heating systems disposed adjacent to each other, in accordance with an embodiment of the invention. Each heating element 402 can include power cords having a female end 405 or a male end 406, which mate as shown in FIG. 4B. The power cords include a ground wire 408 to ensure a common electrical ground among multiple heating systems connected to each other. These power cords, including the continuous ground wire 408, can be disposed above the grounded shield layer 403, alongside grounded shield layer 403, or between grounded shield layer 403 and heating element 402. In some embodiments, the ground wire 408 is 18 American Wire Gauge (AWG). In some embodiments, the ground wire 408 is rated to be used at 600V. In some embodiments, the ground wire 408 is sheathed inside a flame retardant and suitable for use at 90° C. (194° F.) and lower temperatures in dry locations, and at 60° C. (140° F.) and lower temperatures when exposed to moisture.

The connection system disclosed in FIG. 4B can be waterproof (IP68) and polarized. The connection system can also include a termination plug 407 which safely caps the end of a connection if it is not in use. This connection system allows the heating systems to be installed in roof valleys, on roof hips, and around corners. The connection system also allows multiple courses of heating systems to be powered using the same circuit and the same controller.

Figure 4C:
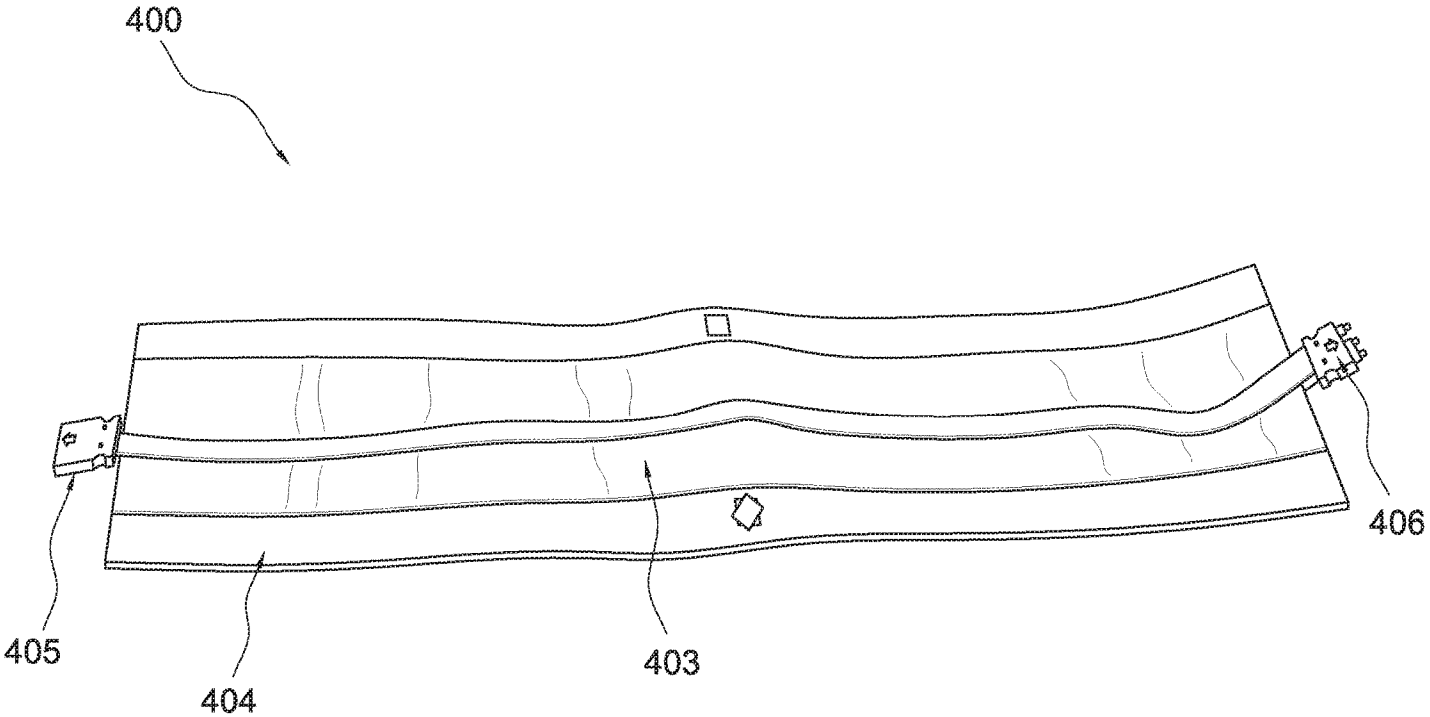
FIG. 4C shows an image of an embodiment of the heating system in accordance with this disclosure.

FIG. 4C shows an image of an embodiment of the heating system in accordance with this disclosure. Shown in the image are the grounded shield layer 403, folded-over rear adhesive strip 404, and the male and female connectors 405 and 406, respectively.

Figure 4D:
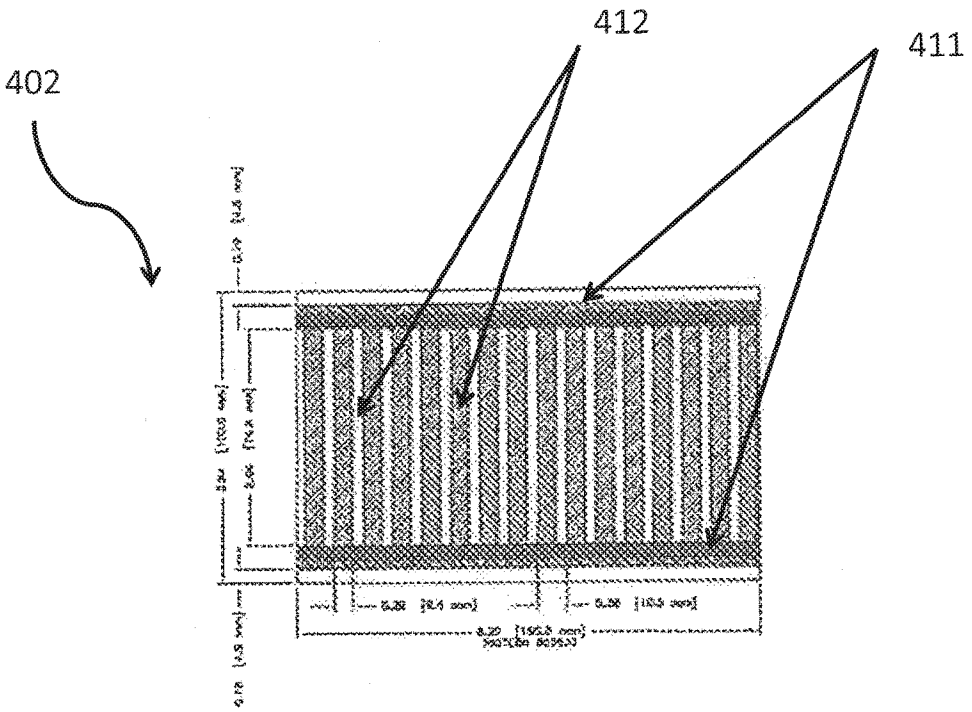
FIG. 4D shows the heating element with an exemplary buss bar pattern 411 that can be printed on the polyester film.

FIG. 4D shows the heating element 402 with an exemplary buss bar pattern 411 that can be printed on the polyester film, although other types of buss bar patterns are also possible. During the lamination process, two tin plated 411 copper buss bars can be inserted. A 24 to 240 Volt voltage can be applied to the heating elements for generation of heat.

Figure 4E:
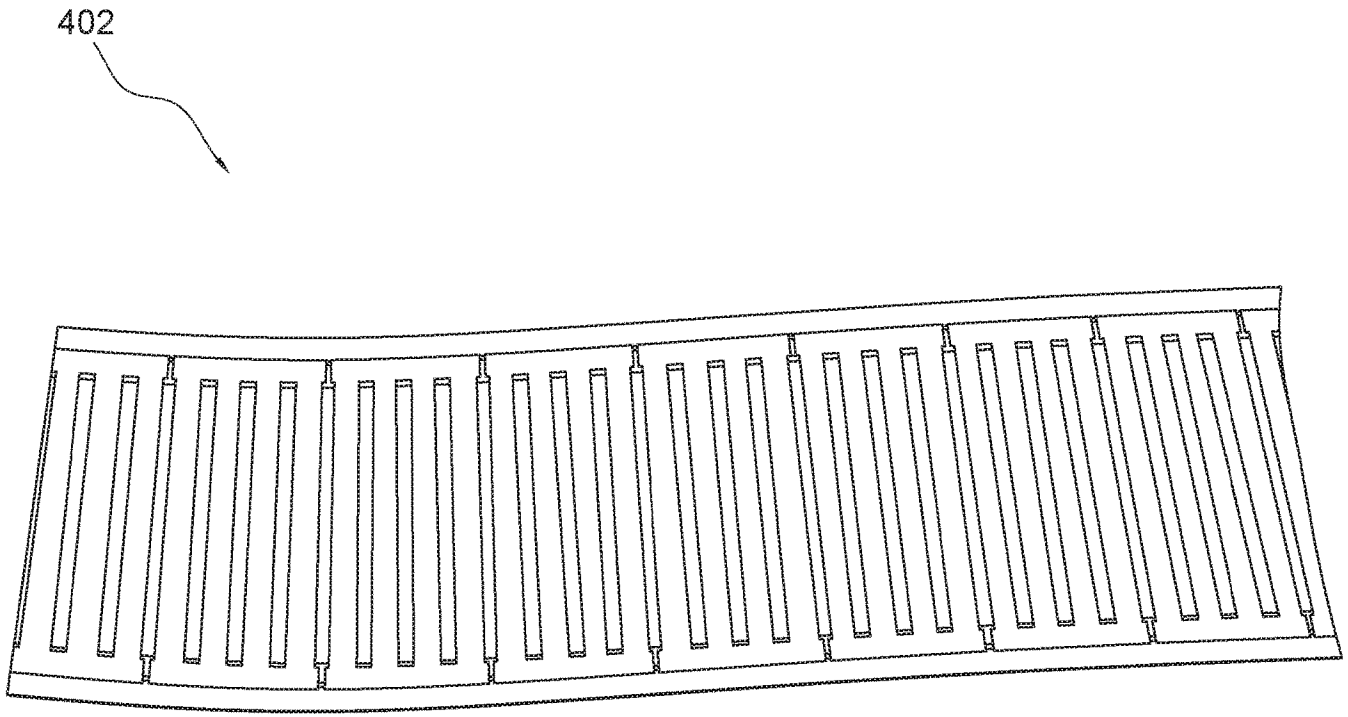
FIG. 4E shows a photograph of one embodiment of the heating element.

The heating element 402 can be a plastic substrate on which is printed heating element 430, although other substrates are possible (e.g., rubber, metal). For example, the heating element 402 can be a pattern of conductive resistive ink that generates heat as electricity passes through it (e.g., via Joule heating). The heating element 402 can include i) a pair of longitudinal stripes 411 extending parallel to and spaced apart from each other and ii) a plurality of bars 412 spaced apart from each other and extending between and electrically connected to the stripes 411. In this configuration, one of the longitudinal stripes 411 can act as a positive bus, and the other longitudinal stripe 411 can act as an negative bus, thus causing a flow of electricity through the bars 412. An embodiment of the heater 402 is described more fully in each of the following U.S. Pat. Nos. 4,485,297, and 4,733,059 each of which are incorporated by reference herein. Other configurations of the heater 425 are possible. A photograph of one embodiment of the heating element is 402 is shown in FIG. 4E.

Figure 4F:
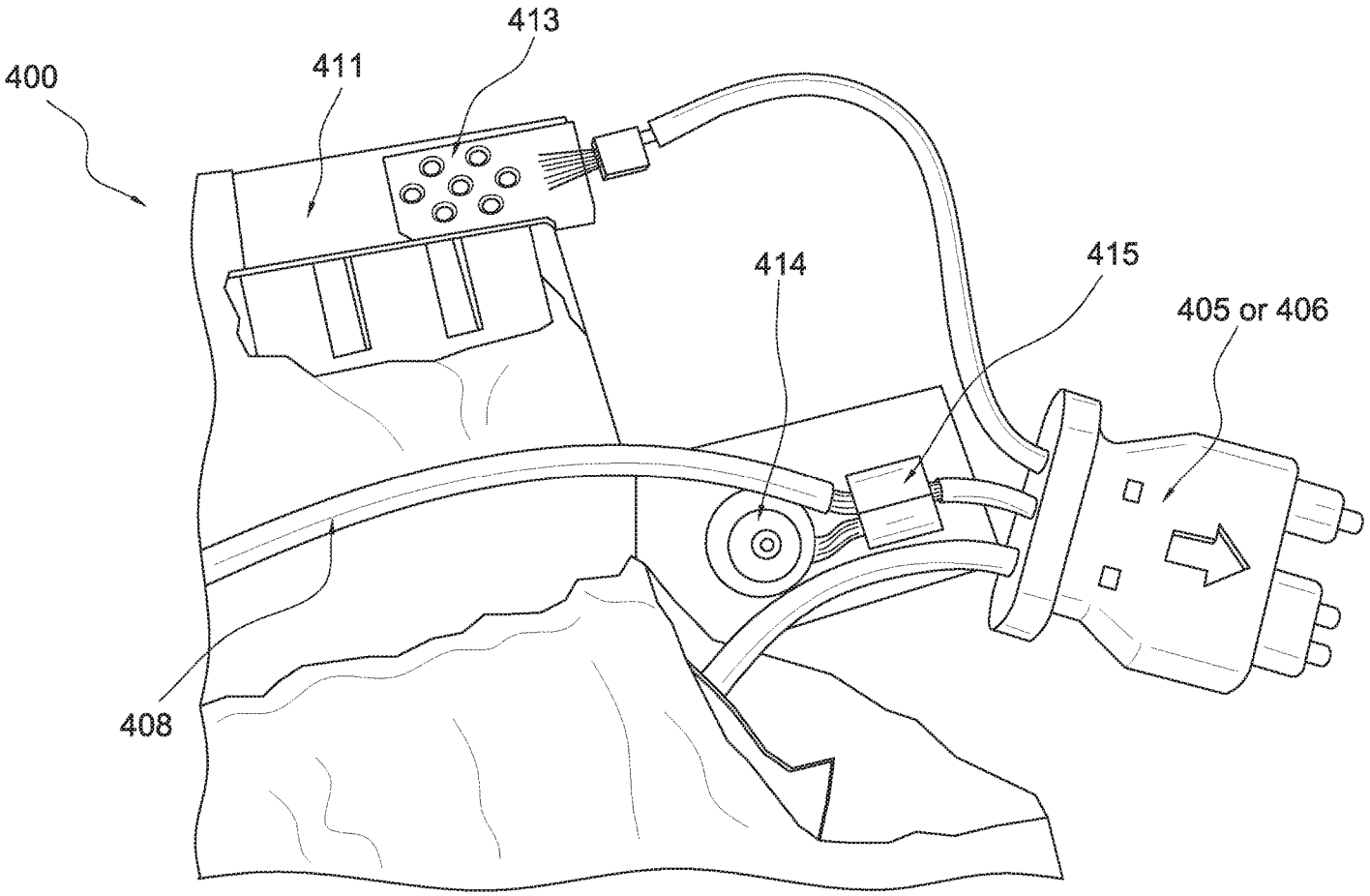
FIG. 4F shows an embodiment of a heating system with the grounded shielded layer peeled off to reveal the electrical connections s to the heating element and the ground wire.

FIG. 4F shows an embodiment of a heating system with the grounded shielded layer 403 peeled off to reveal the electrical connections s to the heating element 402 and the ground wire 408. The connector 413 is attached the bus 411. In some embodiments, the connector may be used as neutral as well. In some embodiments, the connector 413 is crimp styled. In some embodiments, the connector 413 is 0.76 mm thick, barrel range 1.25-2.0 mm and insulated. In some embodiments, the insulation may be a 3M Flame Barrier series insulation tape, such as, FRB NC-127. A blind rivet spacer 414 is provided to connect the ground wire 408 with the top grounded shield layer 403. A high temperature ring connector 415 may be connected to the ground wire 408. The ground wire 408 and connector 413 may be connected to the male or female connectors 405 or 406, as shown in the image.

The spacing of the bars 412 can be configured to cause substantially uniform heating. For example, the width of each bar 412 can be greater than the space between adjacent bars, and the space between bars 412 can be less than an inch, preferably in the range of about ⅛" to 1". The widths of the heating bars is typically in the range of about ⅛" to about 2", preferably about ¼" to ½", although other widths are possible. Other pattern designs for the arrangement of the heater 425 are possible, such as those disclosed in U.S. Pat. No. 4,485,297, which is incorporated by reference herein in its entirety.

The heater 402 can also contains electrodes connected to copper strips extending from an end of the longitudinal stripes 411. Generally, as described in U.S. Pat. No. 4,485,297, the electrodes can provide an electrical connection between the heater 425 and a control unit, which can be, in turn, connected to a power source.

Figure 4G:
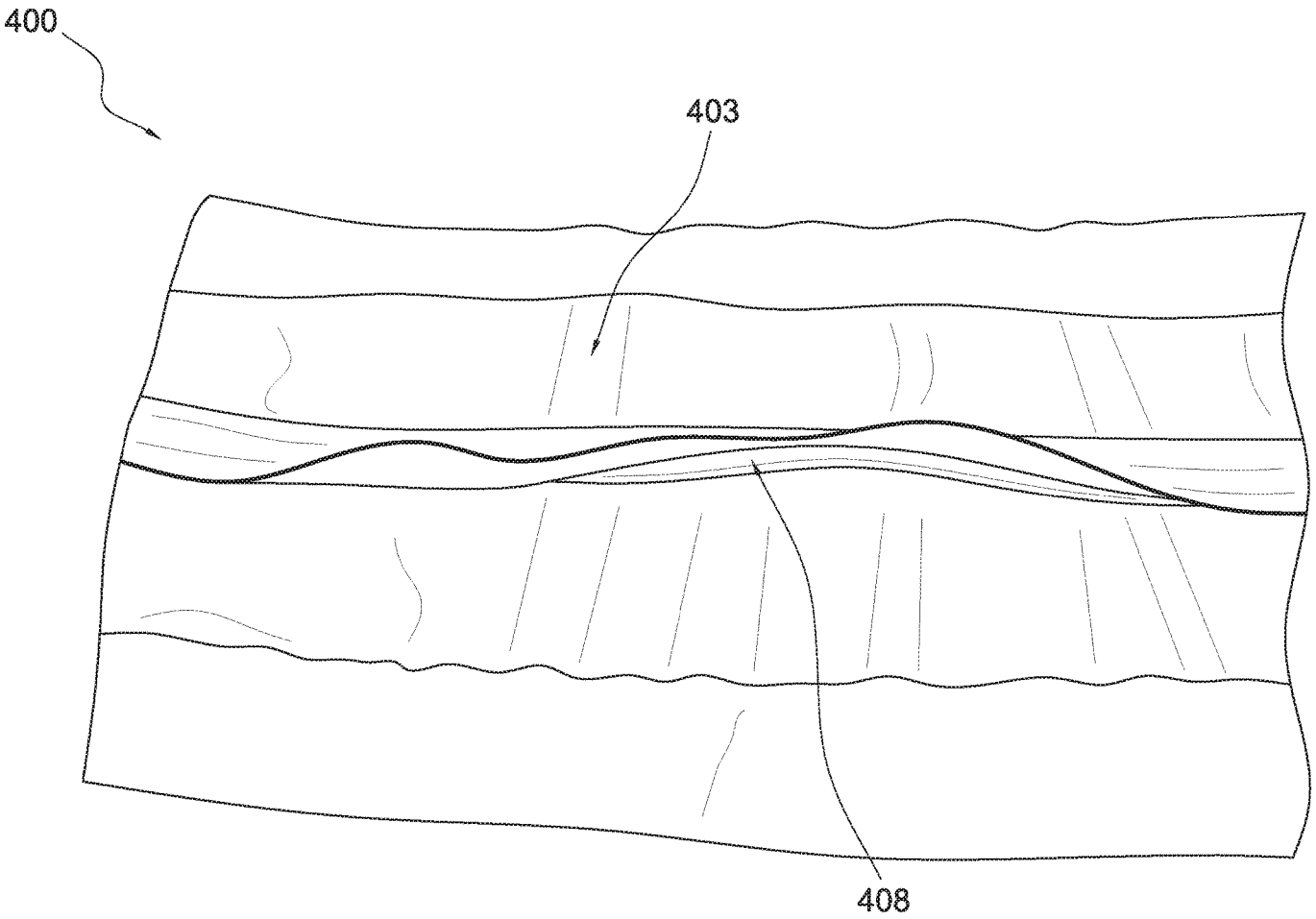
FIG. 4G shows the placement of the ground wire under the grounded shield layer.

In some embodiments, a ground wire 408 may be placed under the grounded shield layer. FIG. 4G shows the placement of the ground wire 408 under the grounded shield layer 403.

In some embodiments, grounded shield layer 403 provides electrical safety. Grounded shield layer 403 can comprise an 0.002 inch to 0.005 inch (2 to 5 mils) thick metal-containing electrically conducting. In some embodiments, the grounded shield layer is flexible. In some embodiments, the metal-containing electrically conducting is made of aluminum, nickel, brass, carbon steel, stainless steel, or a copper-containing alloy that acts as a grounded shield.

In certain other embodiments the grounded shield layer 403 is bonded to a second adhesive layer 409, which is optional, and made of a flame retardant material. In some embodiments the thickness of the second adhesive layer 409 is 1.25 mm. In certain embodiments, the flame retardant material used for making the optional second adhesive layer 409 is selected from a group consisting of flame retardant acrylic adhesives, flame retardant epoxy adhesives, flame retardant silicone adhesives, flame retardant polyether adhesives, flame retardant foams, flame retardant rubber compounds, flame retardant polyurethane, flame retardant non-woven fabric and combinations thereof. In certain other embodiments, the rear adhesive layer 401 can include a Nitto 2125FR flame retardant butyl compound.

In some embodiments, the folded-over rear adhesive strips 404 can be used to adhere the heating system to the shingles above, but in other embodiments, the second layer of adhesive 409 (separate and apart from the rear adhesive layer 401) can be used to bond the heating system to the shingles above more securely.

In an aspect, a heated roof system includes a first course of shingles or an area of the roofing deck; a second course of shingles wherein, the second course of shingles is disposed over at least some part of the first course of shingles or the area of the roofing deck to create an area of overlap; and a heating system disposed in the area of overlap. The heating system includes a grounded shield layer made of a continuous piece of metal; a heating element; and a rear adhesive layer including flame retardant materials; wherein, the heating element is disposed between the grounded shield and the rear adhesive strip; wherein the rear adhesive layer has a bottom surface that is configured to adhere to at least one of a shingle or an area of a roofing deck. The heated roof system also includes a controller configured to control the flow of electricity to the flexible heater as a function of a temperature and at least one of a moisture level and a precipitation level.

Figure 5:
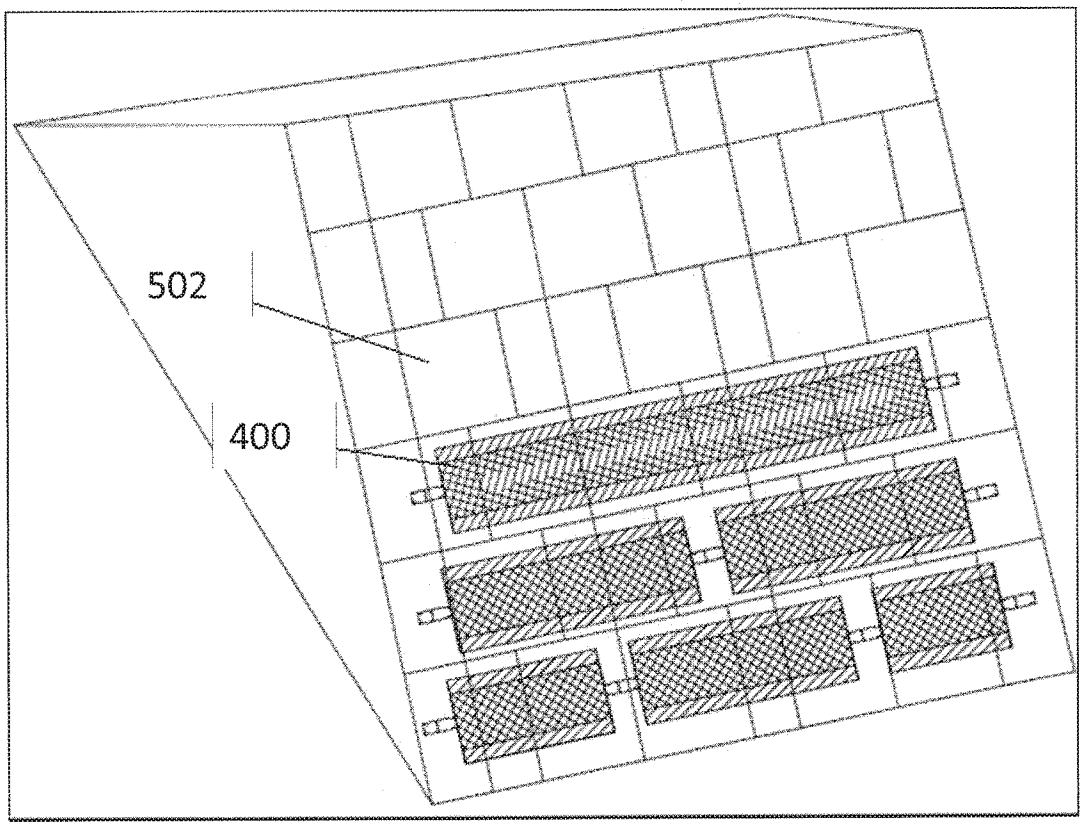
FIG. 5 shows an exemplary cut-away view of three courses of heating systems installed under roofing shingles.

FIG. 5 shows an exemplary cut-away view of three courses of the heating system installed under roofing shingles 502, in accordance with an embodiment of the invention. As can be seen, the heating systems 400 are installed beneath shingles 502 so as to be out of view and protected from damage by the elements. FIG. 5 also shows the folded-over rear adhesive strip 404 underneath the cut-away of the shingles 502 and how the female and male connectors 405 and 406, respectively, connect the adjacent heating systems.

Figure 6:
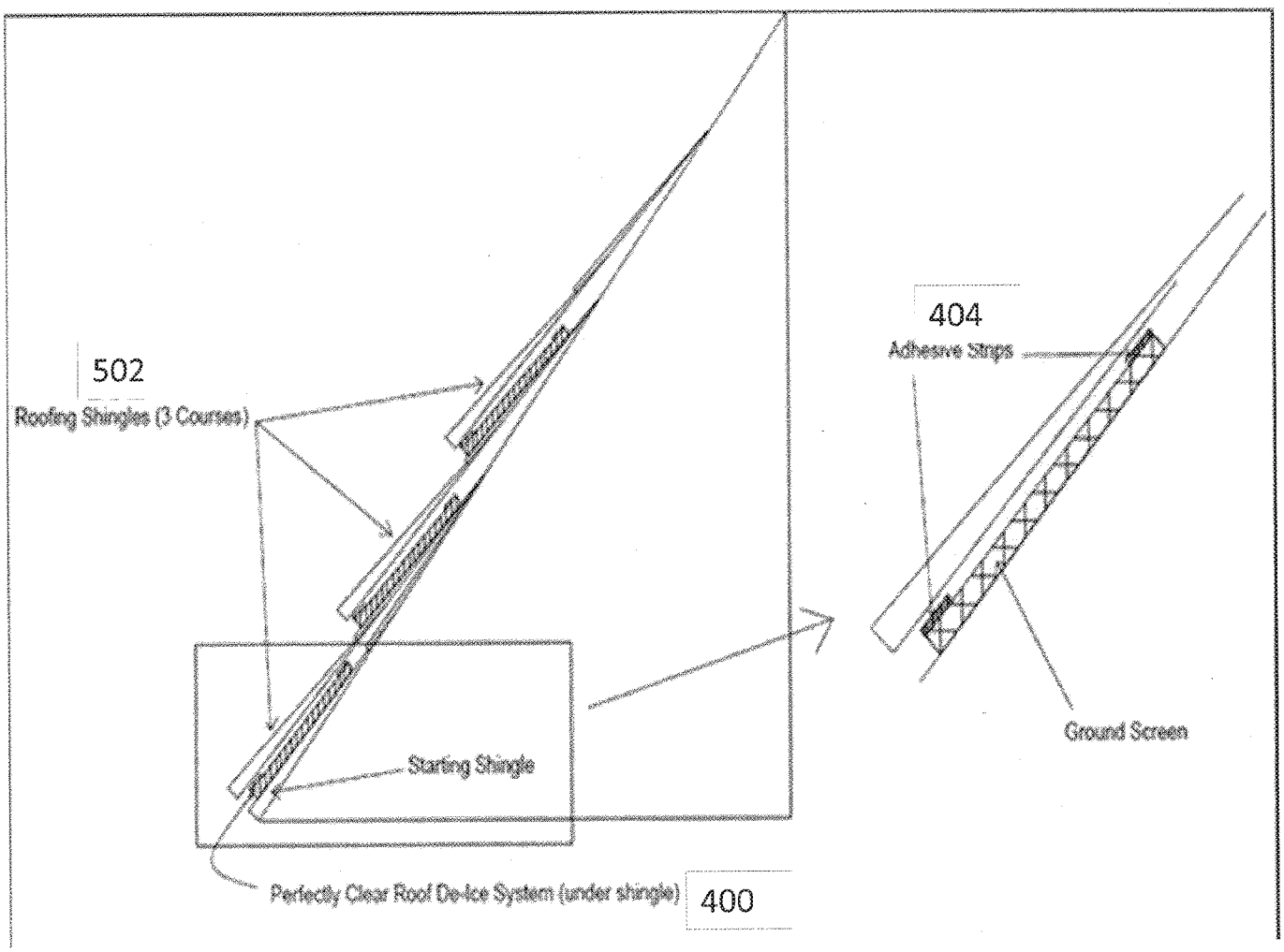
FIG. 6 shows a side view of 3 courses of heating systems under roofing shingles.

FIG. 6 shows a side view of 3 courses of heating systems under roofing shingles, in accordance with an embodiment of the invention. As can be seen, folded-over rear adhesive strips 404 can serve to bond the heating system to the roofing shingle above the heating system 400.

Figure 7:
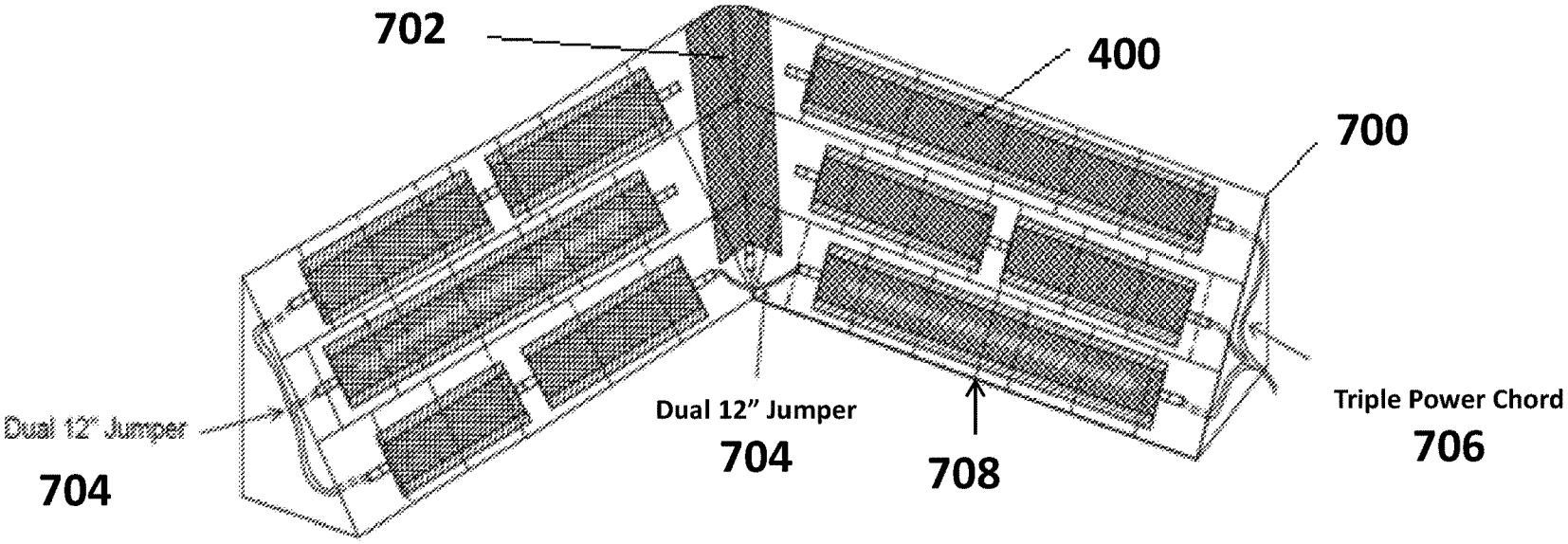
FIG. 7 shows an exemplary installation of heating systems on a roof.

FIG. 7 shows an exemplary installation of heating systems 400 on a roof 700, in accordance with an embodiment of the invention. The heating systems 400 are shown installed along a "valley" 702 and lower edges 708. Three groups of heating systems have been shown connected using a three-way jumper 404 positioned at the bottom of valley 702. The three-way jumper 704 can be useful for connecting multiple groups of heating systems together into one interconnected system. In other embodiments (not shown), four-way, five-way jumpers can also be used. Jumpers that can connect even larger number of heating systems are also possible. A 3-foot power cord 706 provides power to the heating systems installed along both valley 702 and lower edges 708.

Figure 8A:
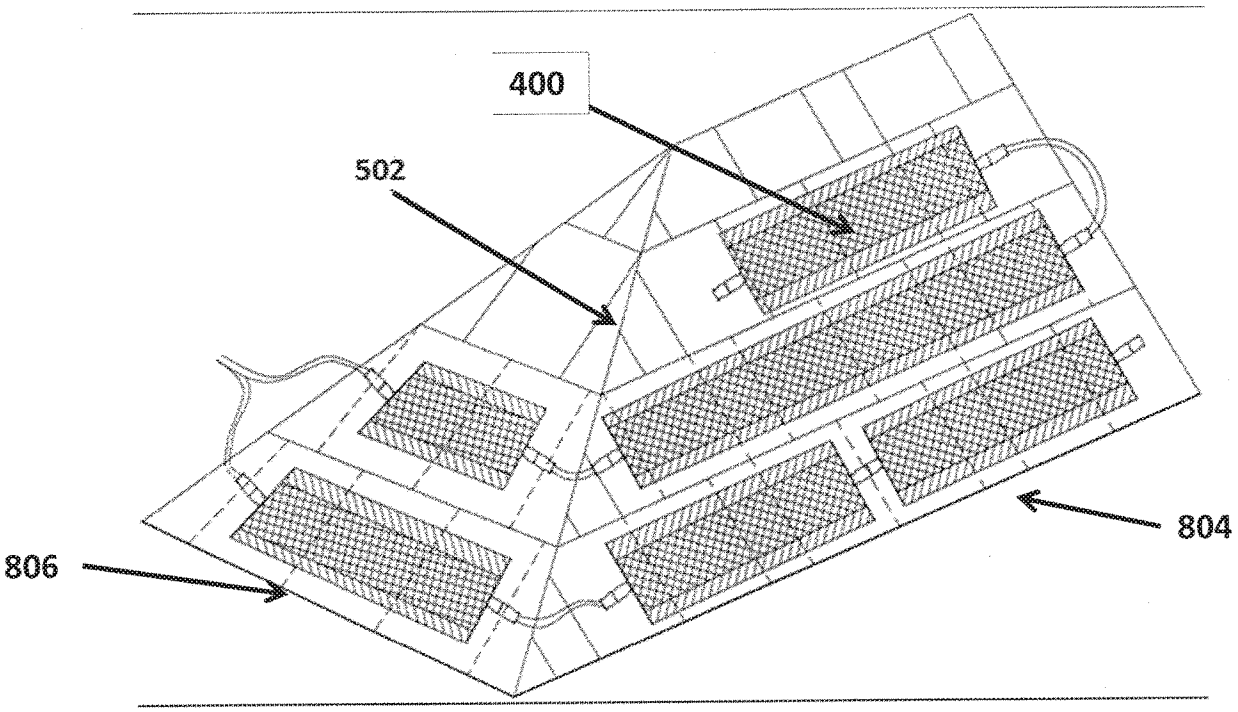
FIG. 8A shows an exemplary installation of heating systems on a "hip" portion of a roof.
Figure 8B:
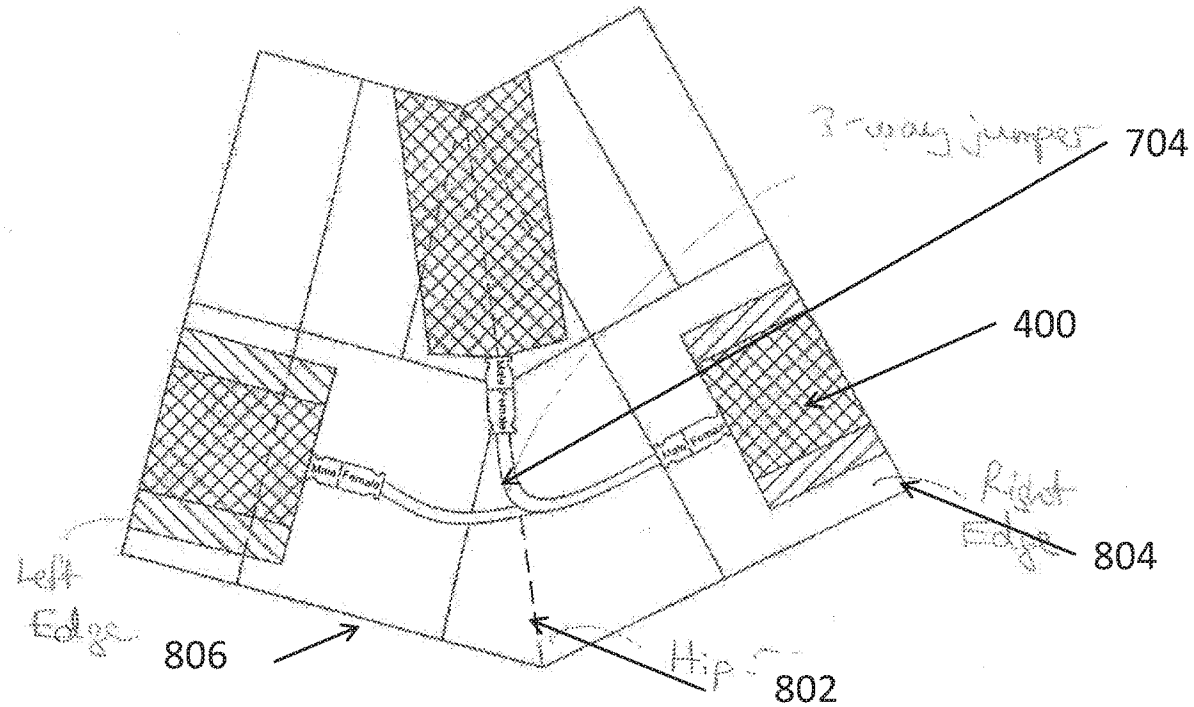
FIG. 8B shows an alternate connecting arrangement for the three groups of heating systems using a 3-way jumper.

FIG. 8A shows an exemplary installation of the heating systems 400 on a "hip" portion 802 of a roof. As shown, three groups of the heating systems can also be installed, one along the "hip" 502, one along a right edge 804, and one along a left edge 806. FIG. 8B shows an alternate connecting arrangement for the three groups of heating systems using a 3-way jumper 704, as disclosed in FIG. 7.

Figure 9:
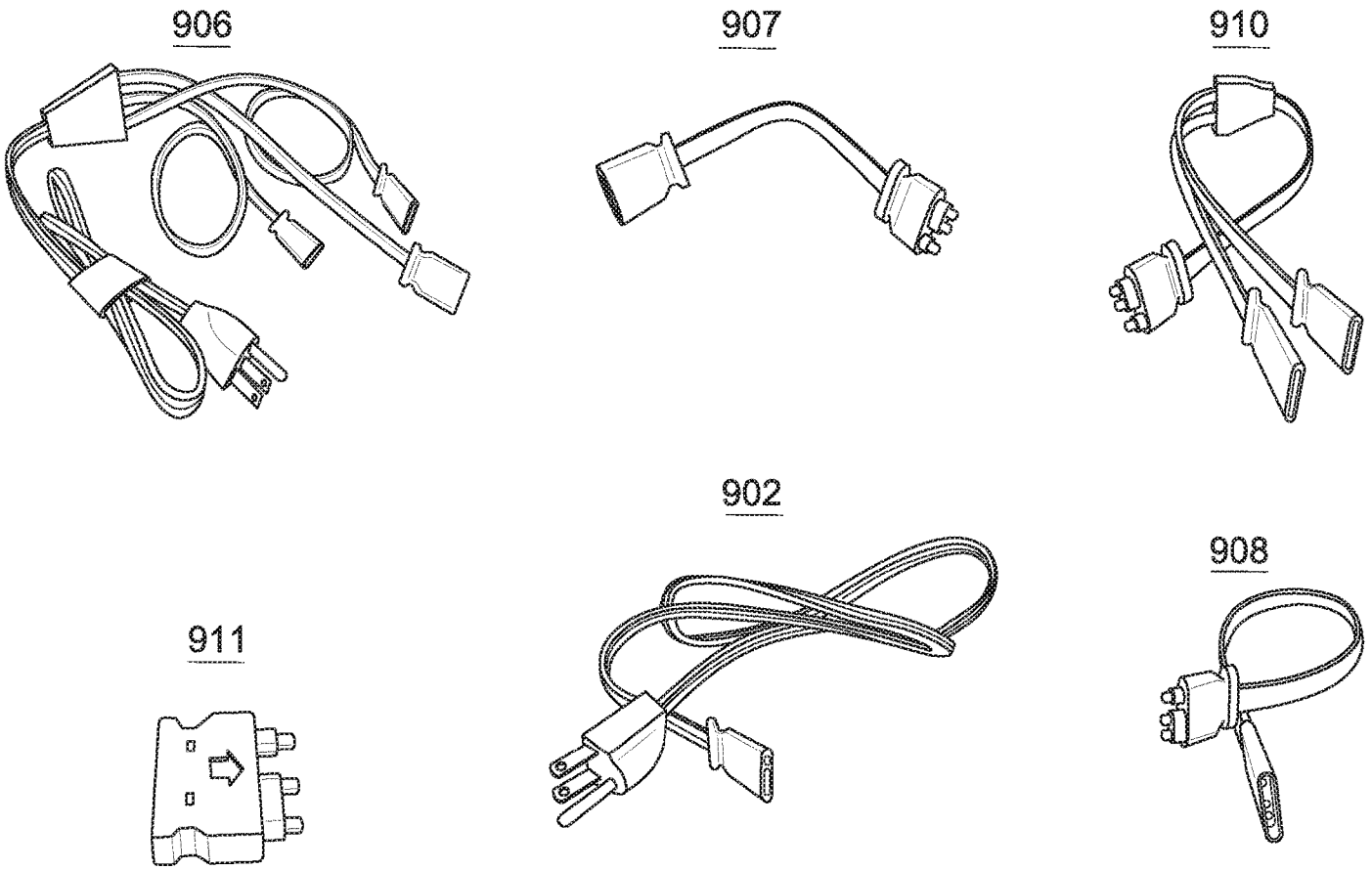
FIG. 9 shows an embodiment of power cords used in the connection of the heating system.

FIG. 9 shows an embodiment of power cords 902 and 906 used in the connection of the heating system 400. Power cords 902 and 906 are similar to each other except that they are of different lengths and power single, double or triple courses, as illustrated. FIG. 6 also includes single jumpers, 607 (6" jumper), and 608 (12"), a three-way jumper 910, and a termination plug 911.

Figure 10A:
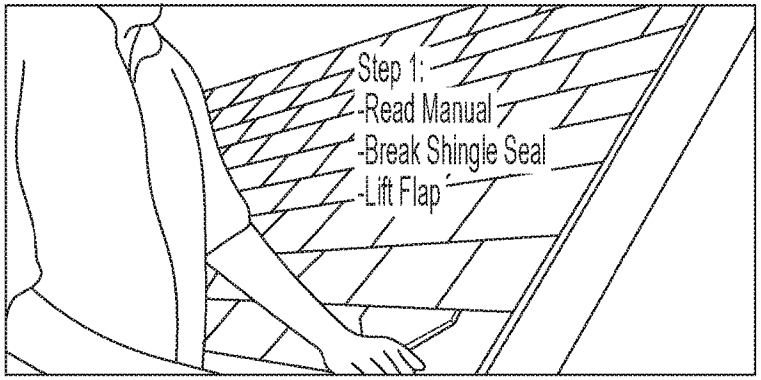
FIG. 10A-10F are a series of figures illustrating an exemplary installation process of a heating system.
Figure 10B:
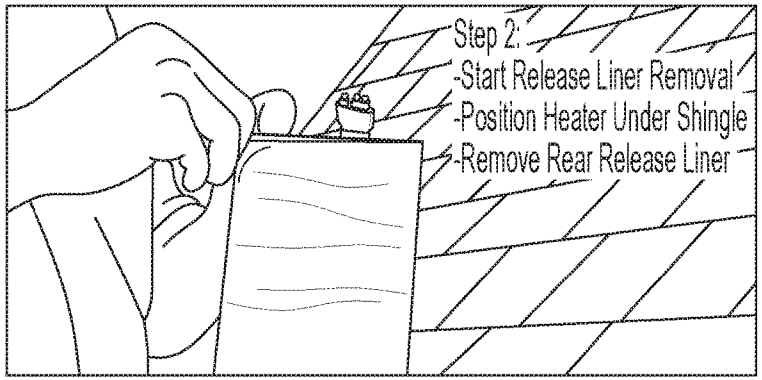
Figure 10C:
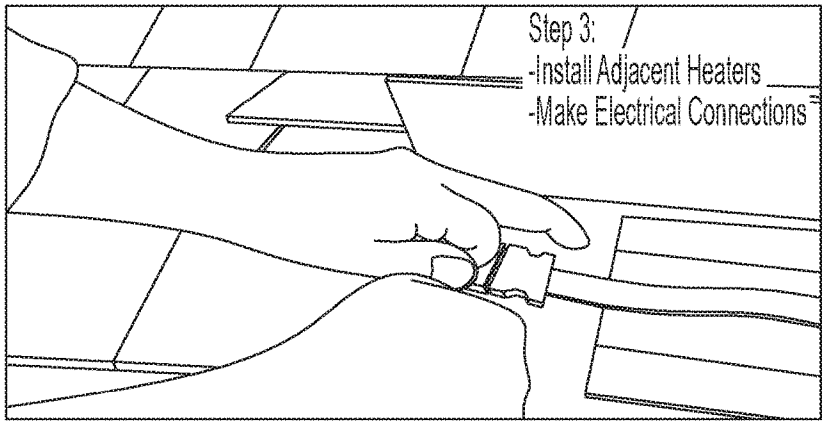
Figure 10D:
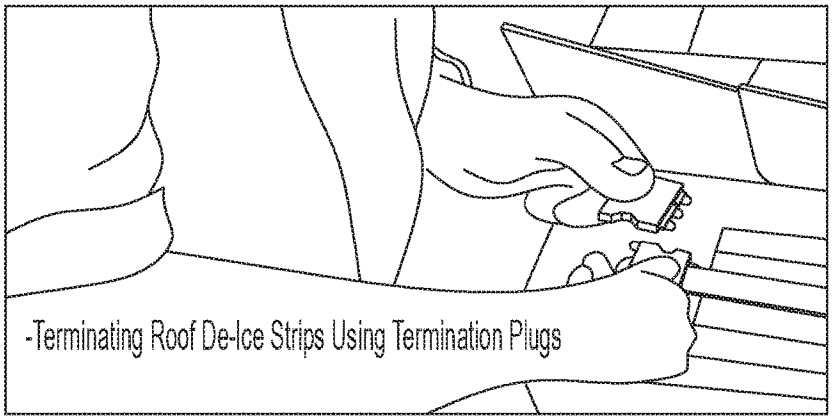
Figure 10E:
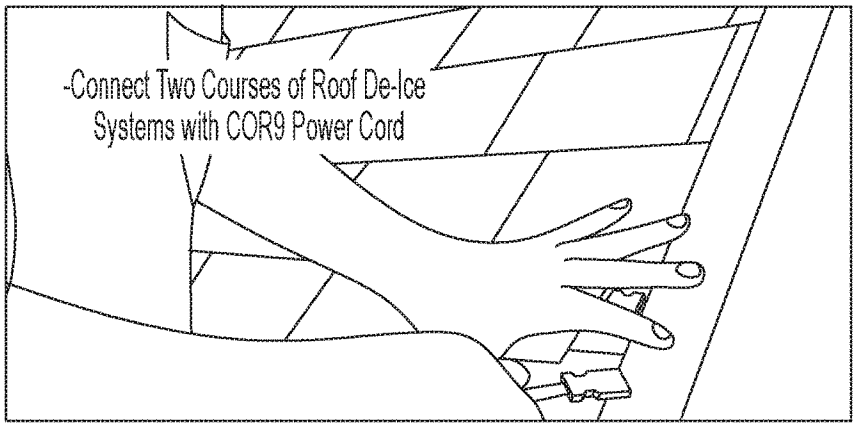
Figure 10F:
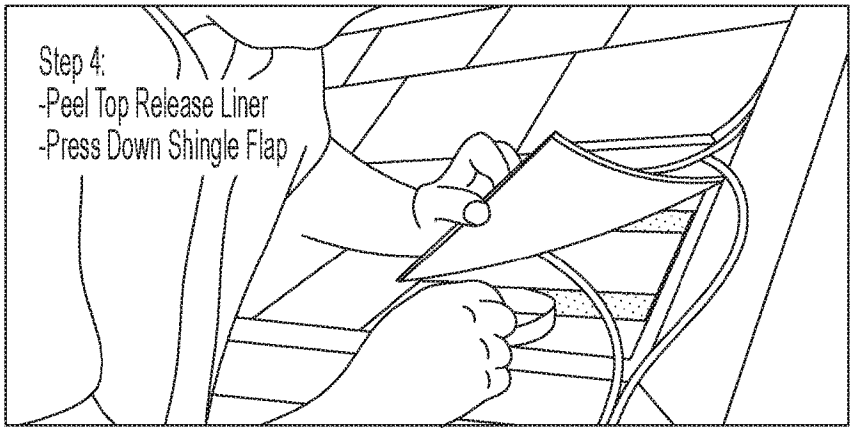

FIG. 10A-10F are a series of figures illustrating an exemplary installation process of a heating system 400. As a first step, as shown in FIG. 10A, a technician can break a shingle seal and lift the shingle flap. As a second step, as shown in FIG. 10B, the technician can peel off/remove a small corner of a protective layer 425 from the adhesive layer 401. Then, the technician can position the heating system under the shingle, remove the rest of the protective layer (rear release liner 425), and press the heating system to the roof underneath to secure the adhesive bond. As a third step, as shown in FIG. 10C, the technician can install adjacent heating system and make the electrical connections by mating the male and female plugs. As part of this step, as shown in FIG. 10D, the technician can add a termination plug to the ends of any power cords not connected to another heating system. As shown in FIG. 10E, the technician can also connect two courses of heating systems using a COR9 power cord. As a fourth step, as shown in FIG. 10F, the technician can peel off a protective layer from the top part of the heating system (either attached to the fold-over rear adhesive strips 404, and/or the optional second layer of adhesive 409 attached to the grounded shield layer 403), then press down the shingle flap to secure the adhesive bond.

The heating system in accordance with this disclosure has several advantages. Some of these are discussed below in the examples that follow.

Resistance to High Force Winds:

The current systems available in the industry use nails to hold the shingles 502 in place. As shown in FIG. 6 the course of shingle that runs on the top overlays the shingles in the course below and the shingles in the top course can be easily lifted up. In fact, as described below in this disclosure, this feature is utilized for easy installation of the heating system using the heating system in accordance with this disclosure.

Additionally, inserting a heating system between the area of overlay between the two courses of shingles further increase the ease with which the shingle of the top course may be lifted up. Thus, high speed wind can lift up the shingles on the top course making the roof prone to leakage in rain. This in certain instances can also void the warranty offered by the shingle manufacturer.

Figure 11B:
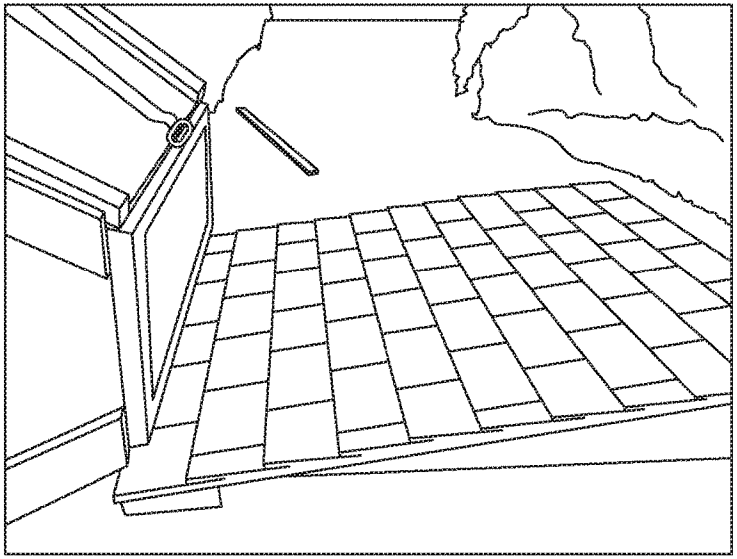
FIGS. 11A and 11B show the set-up for the Fan-Induced Method used for evaluation of the resistance of shingles to high speed winds.
Figure 11A:
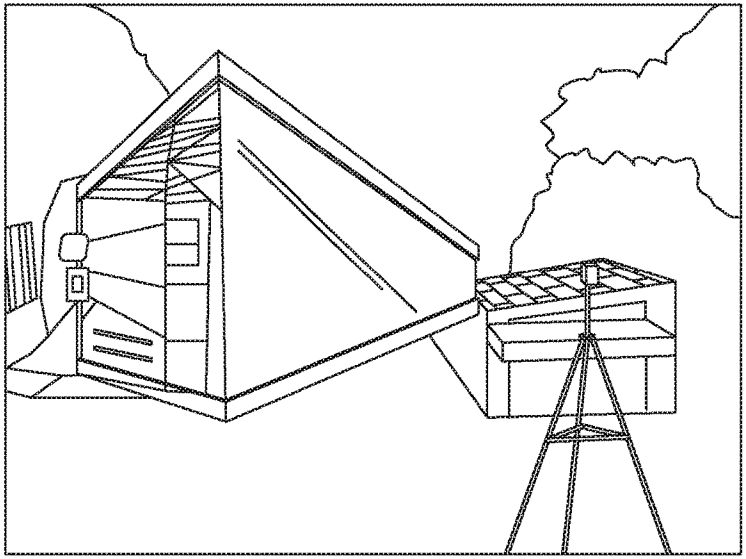

However, in accordance with this disclosure, the bonding of the top shingle to the folded-over rear adhesive strip 404 or the optional adhesive layer 409 improves the integrity of the installed structure. In one embodiment, the heating system used for deicing can be installed without the use of any nails, which is an advantage over prior known deicing systems. In another embodiment, the heating system used for deicing can be installed with nails for added security and structural integrity. The adhesive layers bonding the heating system to the roof or shingle underneath and to the shingles above have been tested for wind uplift by Architectural Testing, a division of Intertek, in accordance with ASTM D3161-09 Standard Test Method for Wind Resistance of Asphalt Shingle (Fan-Induced Method) and met the standard up to 130 MPH with no damage to the roof, even though no nails were used during installation. FIGS. 11A and 11B show the set-up for the Fan-Induced Method used for evaluation of the resistance of shingles to high speed winds.

In some embodiments, the heating system 400 used for deicing can be installed without the use of any nails, which is an advantage over prior known deicing systems. In some other embodiments, the heating system 400 used for deicing can be installed with nails for added security and structural integrity.

Prevention of Corrosion of Electrical Components

As the heating element 402 is shielded and protected by the grounded shield layer 403 and the rear adhesive layer 401, exposure to moisture and precipitation is mitigated and prevented. This is protection is critical. As described above, the bus bar of the heating element 402 is made of copper in many embodiment. Exposure of the metal, such as copper, in the bus bar to water and moisture can result in the onset of corrosion causing the formation of metal oxide, such as, copper oxide. Formation of oxides in heating elements can significantly raises the potential of arcing which poses the hazard of electrical fires.

Further, in some embodiments, the grounded shield layer 403, is also painted with a weather and UV resistant paint to prevent the metallic material used for the grounded shield layer 403 from corrosion. In some embodiments, where aluminum foil is used for the grounded shield layer 403, this becomes important. Aluminum and its alloys are inherently prone to pitting corrosion. Pits formed in the grounded shield layer 403 from elongated exposure to precipitation and moisture can result in ingress points in the grounded shield layer 403 from where water may seep into the cavity where the heating element 402 is located. This can result in electrical faults, short circuiting and even result in a fire hazard.

As another method of improving the reliability and safety in operation of the heating device, in some embodiments, a ground fault circuit interrupter (GFCI) is included in the circuit when power connections are made to the heating system 400. The GFCI measures variations in the current flow. In some embodiments, upon detection of a current fluctuation that is greater than 5 mA, the GFCI trips the circuit and causes the electric power to be shut off and thereby causing the current flow to stop. This prevents potential serious damage, such as, electrical fire from short circuits, arcing, etc.

Flame Retardant Properties

In addition to the provision for a GFCI, as discussed above, the rear adhesive layer 401, the folded-over rear adhesive strip 404 and the optional second adhesive layer 409 are made from materials that are flame retardant. This conscious selection of material further enhances the ability of the heating system 400 to mitigate fire hazard while performing exposed to the weather and elements of nature in close contact and/or close proximity with flammable materials, such as, asphalt shingles and ply board roof decks. Since the design of the heating system 400 ensures that the heating element does not come in direct contact with the shingle or the roof deck, the risk of fire is significantly reduced.

In some embodiments of the heating system 400 in accordance with this disclosure also conform to the UL 499 Electric Heating Appliance standard.

Figure 12:
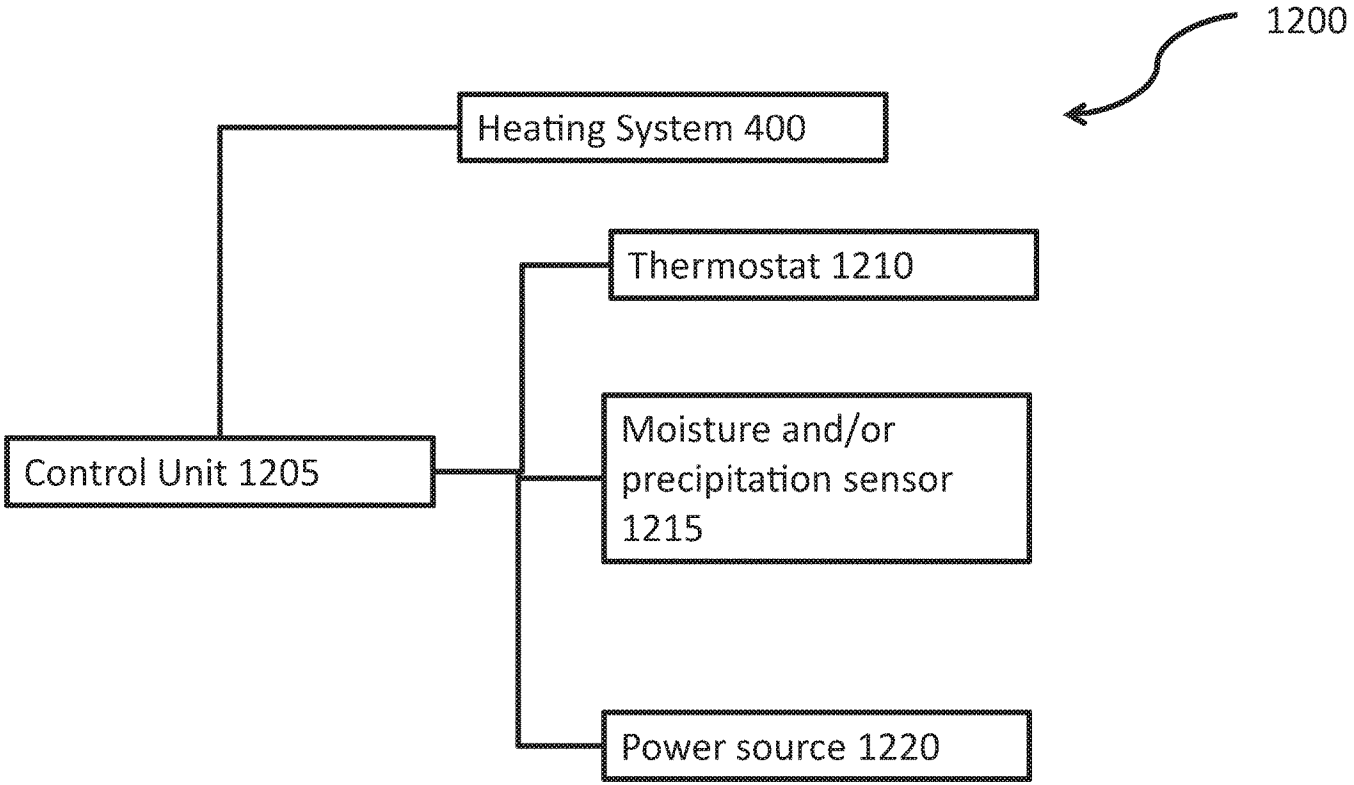
FIG. 12 is an exemplary system with a control unit.

Referring to FIG. 12, the heating system 400 can be controlled by control unit 1205. The control unit 1205 is preferably installed in an area of house 100 not exposed to the elements, and is electrically connected to the heating system 400. The control unit 1205 can be connected to the heating system 400, a thermostat/sensor 1210, a moisture/precipitation sensor 1215, and a power source 1220. The thermostat/sensor 1210 can be part of the control unit 1205, or can be a separate unit that connects to the control unit 1205. In addition, while shown separately, the thermostat/sensor 1210 and moisture/precipitation sensor 1215 can be combined in a single sensor unit. Preferably, the thermostat/sensor 1210 and moisture/precipitation sensor 1215 are installed at the coldest area around the gutter of the house, in a place that is not subject to direct sunlight to ensure that when the moisture/precipitation sensor 1215 is dry, the entire gutter area is dry. In this position, thermostat/sensor 1210 can also determine the ambient air temperature. Control unit 1205 can use information from thermostat/sensor 1210 and moisture/precipitation sensor 1215 to make a determination as to whether power should be supplied to the heating system 400. While the moisture/precipitation sensor 1215 is described as being a combined sensor, another configuration is a sensor that only detects moisture or only detects precipitation.

Figure 13:
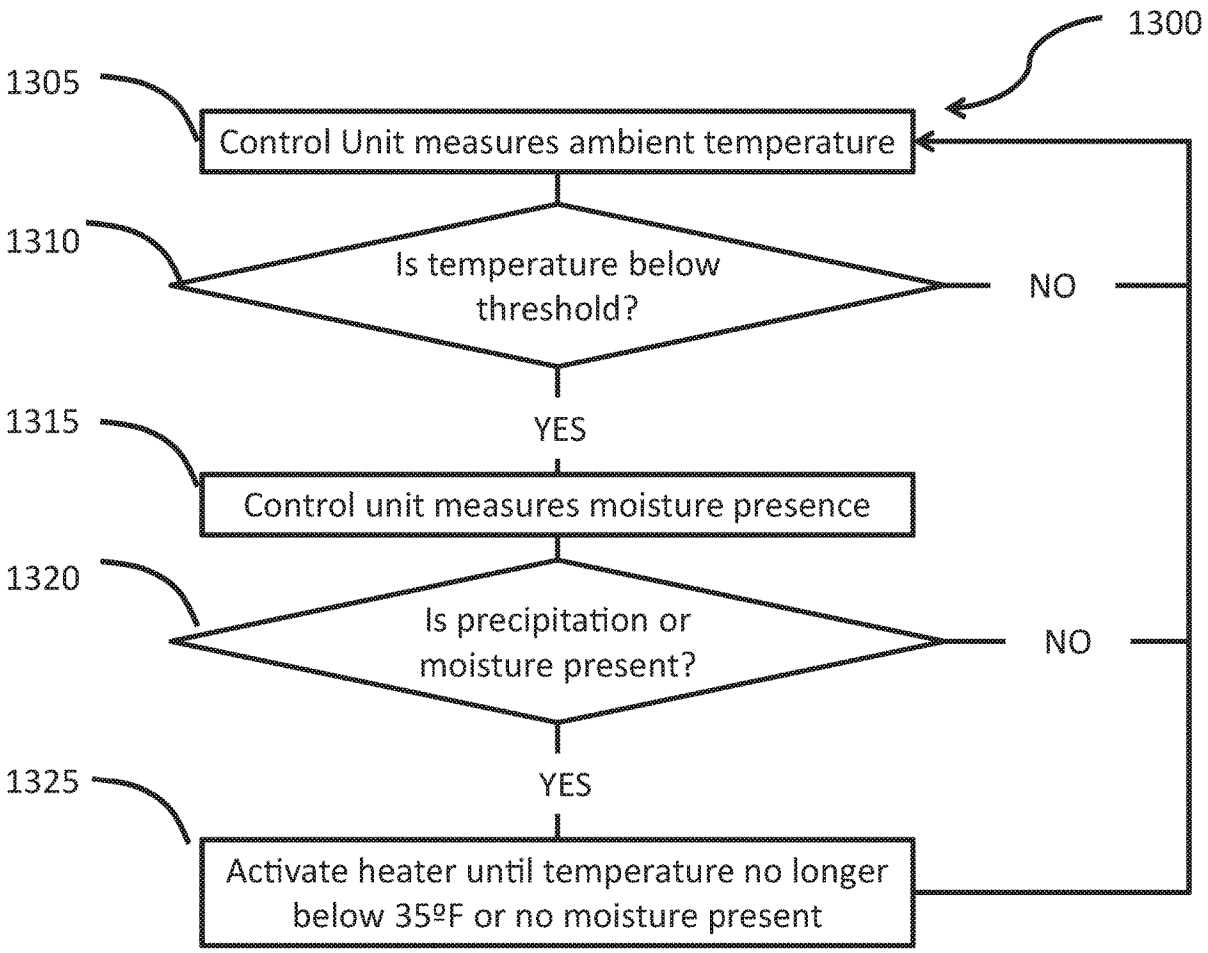
FIG. 13 is an exemplary process of controlling a heating system.

In operation, referring to FIG. 13, with further reference to FIGS. 1-12, a process 1300 for controlling the heating system 400 using the control unit 1205 includes the stages shown. The process 1300, however, is exemplary only and not limiting. The process 1300 may be altered, e.g., by having stages added, changed, removed, or rearranged. The process 1300 can be i) continuously run so that the heating system 400 is always ready, ii) run at specified intervals (e.g., every 20 minutes), and iii) at the direction of an operator.

At stage 1305, the control unit 1205 measures outside air temperature. This can be done by measuring the ambient temperature with thermostat/sensor 1210.

At stage 1310, the control unit 1205 then determines whether the ambient temperature is at or below a predetermined threshold. For example, the control unit can determine if the temperature is at or below 32 degrees Fahrenheit. In other embodiments, the temperature can be set a few degrees higher than freezing, such as 35 degrees Fahrenheit. If the temperature is at or below the predetermined threshold, the process 1300 continues to stage 1315, otherwise the process 1300 continues to stage 1305.

At stage 1315/1320, the control unit 1205 uses moisture/precipitation sensor 1215 to determine if the sensed moisture and/or precipitation level is at or above a predetermined threshold. If the moisture and/or precipitation level is above the threshold, the process 1300 continues to stage 1325, otherwise the process continues to stage 1305

At stage 1325, the control unit 1205 activates the heating system 400 by supplying power from power source 1220. The control unit 1205 preferably keeps the heating system 400 activated until the precipitation and/or moisture level falls below the predetermined threshold, and/or the temperature exceeds the predetermined threshold. The control unit 1205 can also be configured to activate the heating system 400 for a predetermined time period (e.g., 2 hours) after the temperature and moisture/precipitation thresholds are triggered.

The process 1300, vis-à-vis the two-step determination of temperature and moisture/precipitation, can reduce the amount of power consumed by the heating system 400 to prevent the formation of ice dams. If the temperature is above the freezing point in step 1310, e.g., 50 degrees Fahrenheit, then there is little concern that snow or meltwater will freeze at overhang 120, forming an ice dam. Therefore, the continuous sheet heater does not need to be operated. Turning the sheet heater on or off can be accomplished by simply providing power to the heating system 400 or preventing power from being supplied to the heating system 400, in accordance with the sensed conditions as described above. Further, if the temperature is determined to be at or below 35° F. in step 1310, no ice or water will freeze to form an ice dam, if no precipitation and/or moisture is detected in step 1320. Accordingly, heating system 400 should not be active. In the event that the temperature is at or below the freezing point and moisture is detected, than the formation of an ice dam is possible. To prevent the formation of the ice dam, the heating system 400 can be activated by control unit 1205.

The process 1300 and the controller 1200 are preferably configured to operate without any intervention by a user. For example, a homeowner can configure the controller 1200 once, and can the controller 1200 can preferably function without any further input by the homeowner.

In some embodiments, the heating system 400 can be installed on top of standard ice and water shield using adhesive and/or nails before the starter course of shingles is applied. Subsequent courses of the heating system can then be installed as desired.

Other embodiments are within the scope and spirit of the invention. For example, while the foregoing description has focused on the heating system 400 being used to prevent/remove ice dams, the heating system 400 can also be configured to melt snow off of an entire roof (e.g., when snow weight is a concern). In addition, instead of using the process 1300, the heating system 400 can be controlled manually.

The subject matter described herein can be implemented in digital electronic circuitry, or in computer software, firmware, or hardware, including the structural means disclosed in this specification and structural equivalents thereof, or in combinations of them. The subject matter described herein can be implemented as one or more computer program products, such as one or more computer programs tangibly embodied in an information carrier (e.g., in a machine-readable storage device), or embodied in a propagated signal, for execution by, or to control the operation of, data processing apparatus (e.g., a programmable processor, a computer, or multiple computers). A computer program (also known as a program, software, software application, or code) can be written in any form of programming language, including compiled or interpreted languages, and it can be deployed in any form, including as a stand-alone program or as a module, component, subroutine, or other unit suitable for use in a computing environment. A computer program does not necessarily correspond to a file. A program can be stored in a portion of a file that holds other programs or data, in a single file dedicated to the program in question, or in multiple coordinated files (e.g., files that store one or more modules, sub-programs, or portions of code). A computer program can be deployed to be executed on one computer or on multiple computers at one site or distributed across multiple sites and interconnected by a communication network.

The processes and logic flows described in this specification, including the method steps of the subject matter described herein, can be performed by one or more programmable processors executing one or more computer programs to perform functions of the subject matter described herein by operating on input data and generating output. The processes and logic flows can also be performed by, and apparatus of the subject matter described herein can be implemented as, special purpose logic circuitry, e.g., an FPGA (field programmable gate array) or an ASIC (application-specific integrated circuit).

Processors suitable for the execution of a computer program include, by way of example, both general and special purpose microprocessors, and any one or more processor of any kind of digital computer. Generally, a processor will receive instructions and data from a read-only memory or a random access memory or both. The essential elements of a computer are a processor for executing instructions and one or more memory devices for storing instructions and data. Generally, a computer will also include, or be operatively coupled to receive data from or transfer data to, or both, one or more mass storage devices for storing data, e.g., magnetic, magneto-optical disks, or optical disks. Information carriers suitable for embodying computer program instructions and data include all forms of non-volatile memory, including by way of example semiconductor memory devices, (e.g., EPROM, EEPROM, and flash memory devices); magnetic disks, (e.g., internal hard disks or removable disks); magneto-optical disks; and optical disks (e.g., CD and DVD disks). The processor and the memory can be supplemented by, or incorporated in, special purpose logic circuitry.

To provide for interaction with a user, the subject matter described herein can be implemented on a computer having a display device, e.g., a CRT (cathode ray tube) or LCD (liquid crystal display) monitor, for displaying information to the user and a keyboard and a pointing device, (e.g., a mouse or a trackball), by which the user can provide input to the computer. Other kinds of devices can be used to provide for interaction with a user as well. For example, feedback provided to the user can be any form of sensory feedback, (e.g., visual feedback, auditory feedback, or tactile feedback), and input from the user can be received in any form, including acoustic, speech, or tactile input.

The subject matter described herein can be implemented in a computing system that includes a back-end component (e.g., a data server), a middleware component (e.g., an application server), or a front-end component (e.g., a client computer having a graphical user interface or a web browser through which a user can interact with an implementation of the subject matter described herein), or any combination of such back-end, middleware, and front-end components. The components of the system can be interconnected by any form or medium of digital data communication, e.g., a communication network. Examples of communication networks include a local area network ("LAN") and a wide area network ("WAN"), e.g., the Internet.

It is noted that one or more references are incorporated herein. To the extent that any of the incorporated material is inconsistent with the present disclosure, the present disclosure shall control. Furthermore, to the extent necessary, material incorporated by reference herein should be disregarded if necessary to preserve the validity of the claims.

To the extent certain functionality or components "can" or "may" be performed or included, respectively, the identified functionality or components are not necessarily required in all embodiments, and can be omitted from certain embodiments of the invention.

Further, while the description above refers to the invention, the description may include more than one invention. Upon review of the description and embodiments provided herein, those skilled in the art will understand that modifications and equivalent substitutions may be performed in carrying out the invention without departing from the essence of the invention. Thus, the invention is not meant to be limiting by the embodiments described explicitly above.

What is claimed is:

1. A heating system comprising:

a grounded shield layer made of a continuous piece of metal;

a heating element;

a rear adhesive layer comprising of a flame retardant material;

wherein, the heating element is disposed between the grounded shield layer and the rear adhesive layer;

wherein the rear adhesive layer has a bottom surface that is configured to adhere to at least one of a shingle or an area of a roofing deck;

a controller configured to control the flow of electricity to the heating element as a function of a temperature and at least one of a moisture level and a precipitation level; and an additional adhesive layer comprising of a flame retardant material, wherein, the additional adhesive layer is disposed on top of the grounded shield layer and configured to adhere to the at least one of the shingle or the area of the roofing deck.

2. The heating system of claim 1, wherein, the grounded shield layer is flexible.

3. The heating system of claim 1, wherein, the grounded shield layer is made of a metal-containing electrically conducting foil.

4. The heating system of claim 3, wherein, the metal-containing electrically conducting foil is painted over with a weather resistant and UV resistant paint.

5. The heating system of claim 1, wherein, the controller is configured to control the flow of electricity continuously, at specific intervals and/or with manual regulation of an operator.

6. The heating system of claim 1, wherein, the controller is configured to flow electricity when the ambient temperature is below a predetermined threshold.

7. The heating system of claim 1, wherein the rear adhesive layer is covered by a release liner that is configured to be removed before installation.

8. The heating system of claim 1, wherein the flame retardant material comprising the rear adhesive layer is selected from a group consisting of flame retardant acrylic adhesives, flame retardant epoxy adhesives, flame retardant silicone adhesives, flame retardant polyether adhesives, flame retardant foams, flame retardant rubber compounds, flame retardant polyurethane, flame retardant non-woven fabric and combinations thereof.

9. The heating system of claim 1, wherein, the heating element comprises:

a pair of longitudinal stripes spaced apart from each other; and a plurality of transverse bars configured to be spaced apart from each other to cause substantially uniform heating and extending between the longitudinal stripes.

10. The heating system of claim 9, wherein, the pair of longitudinal stripes are made of a material comprising copper.

11. The heating system of claim 1, wherein the flame retardant material comprising the additional adhesive layer is selected from a group consisting of flame retardant acrylic adhesives, flame retardant epoxy adhesives, flame retardant silicone adhesives, flame retardant polyether adhesives, flame retardant foams, flame retardant rubber compounds, flame retardant polyurethane, flame retardant non-woven fabric and combinations thereof.

12. A heating system comprises:

a grounded shield layer made of a continuous piece of metal;

a heating element;

a rear adhesive layer comprising of a flame retardant material;

wherein, the heating element is disposed between the grounded shield layer and the rear adhesive layer;

wherein the rear adhesive layer has a bottom surface that is configured to adhere to at least one of a shingle or an area of a roofing deck;

a controller configured to control the flow of electricity to the heating element as a function of a temperature and at least one of a moisture level and a precipitation level;

wherein, the grounded shield layer has a transverse dimension forming two transverse edges which is shorter than the width of the rear adhesive layer; and wherein, the rear adhesive layer is configured to fold over at least one of the transverse edges of the grounded shield layer to form a region of folded-over rear adhesive strip.

13. The heating system of claim 12, wherein, the region of the folded rear adhesive strip is adhered to a shingle disposed on top of the heating system.

14. A heated roof system comprising:

a first course of shingles or an area of a roofing deck;

a second course of shingles wherein, the second course of shingles is disposed over at least one of a part of the first course of shingles and a part of the area of the roofing deck to create an area of overlap;

a heating system disposed in the area of overlap, wherein, the heating system comprises, a grounded shield layer made of a continuous piece of metal; a heating element; and a rear adhesive layer comprising a flame retardant material;

wherein, the heating element is disposed between the grounded shield layer and the rear adhesive layer;

wherein the rear adhesive layer has a bottom surface that is configured to adhere to at least one of a shingle or an area of a roofing deck; and a controller configured to control the flow of electricity to the heating element as a function of a temperature and at least one of a moisture level and a precipitation level.

15. The heated roof system of claim 14, wherein, the first course of shingles is installed over an overhang of a roof.

16. The heated roof system of claim 14, wherein, the grounded shield layer has a transverse dimension forming two transverse edges which is shorter than the width of the rear adhesive layer; and wherein, the rear adhesive layer is configured to fold over at least one of the transverse edges of the grounded shield layer to form a region of folded-over rear adhesive strip.

17. The heated roof system of claim 16, wherein, the region of folded rear adhesive strip is adhered to the second course of shingles disposed on top of the heating system.

18. The heated roof system of claim 17, wherein the second course of shingles disposed on top of the heating system remain adhered to the region of folded-over adhesive strip upon exposure to a hurricane force wind.

19. The heated roof system of claim 18, wherein the hurricane force wind has of speeds greater than 130 mph.

20. The heated roof system of claim 14, wherein, the grounded shield layer is flexible.

21. The heated roof system of claim 14, wherein, the grounded shield layer is made of a metal-containing electrically conducting foil.

22. The heated roof system of claim 21, wherein, the metal-containing electrically conducting foil is painted over with a weather resistant and UV resistant paint.

23. The heated roof system of claim 14, wherein, the controller is configured to control the flow of electricity continuously, at specific intervals and/or with manual regulation of an operator.

24. The heated roof system of claim 14, wherein, the controller is configured to flow electricity when the ambient temperature is below a predetermined threshold.

25. The heated roof system of claim 14, wherein the rear adhesive layer is covered by a release liner that is configured to be removed before installation.

26. The heated roof system of claim 14, wherein the flame retardant material comprising the rear adhesive layer is selected from a group consisting of flame retardant acrylic adhesives, flame retardant epoxy adhesives, flame retardant silicone adhesives, flame retardant polyether adhesives, flame retardant foams, flame retardant rubber compounds, flame retardant polyurethane, flame retardant non-woven fabric and combinations thereof.

27. The heated roof system of claim 14, wherein, the heating element comprises:

a pair of longitudinal stripes spaced apart from each other; and a plurality of transverse bars configured to be spaced apart from each other to cause substantially uniform heating and extending between the longitudinal stripes.

28. The heated roof system of claim 27, wherein, the pair of longitudinal stripes of the heating element are made of a material comprising copper.

29. The heated roof system of claim 14, further comprising an additional adhesive layer comprising of a flame retardant material;

wherein, the additional adhesive layer is disposed on top of the grounded shield layer and configured to adhere to the shingle disposed on top of the heating system.

30. The heated roof system of claim 29, wherein the flame retardant material comprising the additional adhesive layer is selected from a group consisting of flame retardant acrylic adhesives, flame retardant epoxy adhesives, flame retardant silicone adhesives, flame retardant polyether adhesives, flame retardant foams, flame retardant rubber compounds, flame retardant polyurethane, flame retardant non-woven fabric and combinations thereof.

* * * * *